US009669995B2

(12) United States Patent
Hess et al.

(10) Patent No.: US 9,669,995 B2
(45) Date of Patent: Jun. 6, 2017

(54) WASTE CONTAINMENT RECEPTACLE WITH CLAMP ACTUATORS

(71) Applicant: 1908 Brands, Inc., Boulder, CO (US)

(72) Inventors: William Hess, Broomfield, CO (US); Kristen Hess, Broomfield, CO (US)

(73) Assignee: 1908 BRANDS, INC., Boulder, CO (US)

( * ) Notice: Subject to any disclaimer, the term of this patent is extended or adjusted under 35 U.S.C. 154(b) by 0 days.

(21) Appl. No.: 15/095,819

(22) Filed: Apr. 11, 2016

(65) Prior Publication Data

US 2016/0221753 A1 Aug. 4, 2016

Related U.S. Application Data

(63) Continuation of application No. 14/607,324, filed on Jan. 28, 2015, now Pat. No. 9,309,049, which is a continuation of application No. 14/279,205, filed on May 15, 2014, now Pat. No. 8,978,917.

(60) Provisional application No. 61/841,373, filed on Jun. 30, 2013.

(51) Int. Cl.

| | |
|---|---|
| ***B65F 1/16*** | (2006.01) |
| ***B65D 43/26*** | (2006.01) |
| ***B65F 1/06*** | (2006.01) |
| ***B65F 1/12*** | (2006.01) |
| ***B65F 1/14*** | (2006.01) |

(52) U.S. Cl.

CPC ..... *B65F 1/163* (2013.01); *B65D 43/262* (2013.01); *B65F 1/06* (2013.01); *B65F 1/122* (2013.01); *B65F 1/1415* (2013.01); *B65F 1/1421* (2013.01); *B65F 1/16* (2013.01); *B65F 1/1468* (2013.01); *B65F 2001/1653* (2013.01); *B65F 2001/1676* (2013.01); *B65F 2210/167* (2013.01); *B65F 2240/132* (2013.01)

(58) Field of Classification Search

CPC ..... B65F 1/163; B65F 1/1623; B65F 1/16; B65F 1/06; B65F 1/1468; B65F 1/12; B65F 1/1421; B65F 1/1415; B65D 43/262; B65D 43/26

USPC ..... 220/264, 263, 262, 260, 495.08, 495.06, 220/495.01, 908.1, 908; D34/9, 8, 7

See application file for complete search history.

(56) References Cited

U.S. PATENT DOCUMENTS

| | | | |
|---|---|---|---|
| 2,527,449 | A | 10/1950 | Poole et al. |
| 3,807,598 | A | 4/1974 | Nutt |
| 3,836,037 | A | 9/1974 | Bass |
| 5,125,526 | A | 6/1992 | Sumanis |

(Continued)

FOREIGN PATENT DOCUMENTS

| | | |
|---|---|---|
| JP | 2005058971 | 3/2005 |
| JP | 3828107 | 10/2005 |

(Continued)

*Primary Examiner* — Robert J Hicks

(74) *Attorney, Agent, or Firm* — Cislo & Thomas, LLP

(57) ABSTRACT

A waste receptacle for collecting waste with a carrier that allows for easy transport. The receptacle uses a closing system to manage odor, and an actuator system to open and close the closing system. The closing system has a clamping mechanism housed inside a body that can clamp a bag placed inside the body with the opening of the bag disposed about the clamping mechanism. The receptacle may also have a lid in which actuation of the actuator system causes the clamping mechanism to open and close simultaneously with the lid. The actuation system may utilize pedals that can be replaced with a hand actuator.

21 Claims, 21 Drawing Sheets

(56) References Cited

U.S. PATENT DOCUMENTS

| | | | |
|---|---|---|---|
| 5,127,519 | A | 7/1992 | Tsao |
| 5,213,228 | A | 5/1993 | Chang |
| 5,215,089 | A | 6/1993 | Baker, Jr. |
| 5,322,179 | A | 6/1994 | Ting |
| 6,241,115 | B1 | 6/2001 | Schulz |
| 6,719,194 | B2 | 4/2004 | Richards |
| 6,817,164 | B2 | 11/2004 | Mauffette et al. |
| 6,941,733 | B2 | 9/2005 | Chomik |
| 7,178,314 | B2 | 2/2007 | Chomik et al. |
| D571,520 | S | 6/2008 | Lin |
| 7,401,708 | B2 | 7/2008 | Lin |
| 7,963,414 | B1 | 6/2011 | Stravitz |
| 8,087,532 | B2 | 1/2012 | Brown et al. |
| 8,091,325 | B2 | 1/2012 | Stravitz et al. |
| 8,127,519 | B2 | 3/2012 | Stravitz |
| 8,136,688 | B2 | 3/2012 | Lee et al. |
| 8,235,237 | B1 | 8/2012 | Stravitz |
| 8,266,871 | B1 | 9/2012 | Stravitz |
| 2005/0044819 | A1 | 3/2005 | Chomik et al. |
| 2011/0309082 | A1 | 12/2011 | Morand |

FOREIGN PATENT DOCUMENTS

| | | |
|---|---|---|
| JP | 4437249 | 3/2010 |
| WO | WO 2011/01189 | 2/2011 |

WASTE CONTAINMENT RECEPTACLE WITH CLAMP ACTUATORS

CROSS-REFERENCE TO RELATED APPLICATION

This application is a continuation of U.S. application Ser. No. 14/607,324, filed Jan. 28, 2015, entitled "Waste Containment Receptacle," which is a continuation of U.S. application Ser. No. 14/279,205, filed May 15, 2014, entitled "Waste Containment Receptacle," now U.S. Pat. No. 8,978,917, which claims the benefit of U.S. Provisional Application No. 61/841,373, filed Jun. 30, 2013, which applications are incorporated here in their entirety by this reference.

TECHNICAL FIELD

This invention is related to waste disposal containers for collecting odorous material.

BACKGROUND

There is a need for an indoor storage container that eliminates the obvious side effects associated with storing unpleasant waste materials (e.g. organic waste, diapers, pet waste, fish, regular trash, and other smelly material) in one's living space, specifically odors, pests, and messes. This will help reduce the amount of half-filled plastic bags going to the landfill and reduce the frequency of taking out the trash. The invention is unique because it may automatically open and close a trash liner hands free, which of course is much more sanitary than removing tops and lids and fumbling with a soiled liner. It is also unique because it places a seal in the trash liner between uses, trapping the foul odor of offensive waste inside the liner while blocking out pests and pets. In addition, the invention's removable components make it adaptable for a variety of storage applications.

SUMMARY

The invention of the present application is a waste receptacle comprising a body defining a cavity in which waste can be collected, a closing system to manage odor, and an actuator system to open and close the waste receptacle.

The closing system comprises a clamping mechanism housed inside the body. A bag or liner is placed inside the body with the opening of the bag disposed about the clamping mechanism. Actuation of the actuator system causes the clamping mechanism to open and close so as to open and close the opening of the bag. The closing system may further comprise a lid that opens and closes simultaneously with the clamping mechanism.

The actuator system may comprise a pair of pedal levers connected to the bottom of the waste receptacle, where depression of one pedal simultaneously opens the clamping mechanism and lid, and depression of the other pedal simultaneously closes the clamping mechanism and the lid.

The lid and pedal levers can be replaced with a hand actuator so that the clamping mechanism can be opened and closed with the hand rather than the feet using the pedals. The handle actuator can directly replace the lid and the pedal levers, if desired. In this configuration, the waste receptacle may be placed inside a cabinet.

A carrier may also be provided that can be housed in the body to support the waste collected in the bag. The carrier provides added support to transport the waste from the body to a desired location to be disposed or used as compost.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
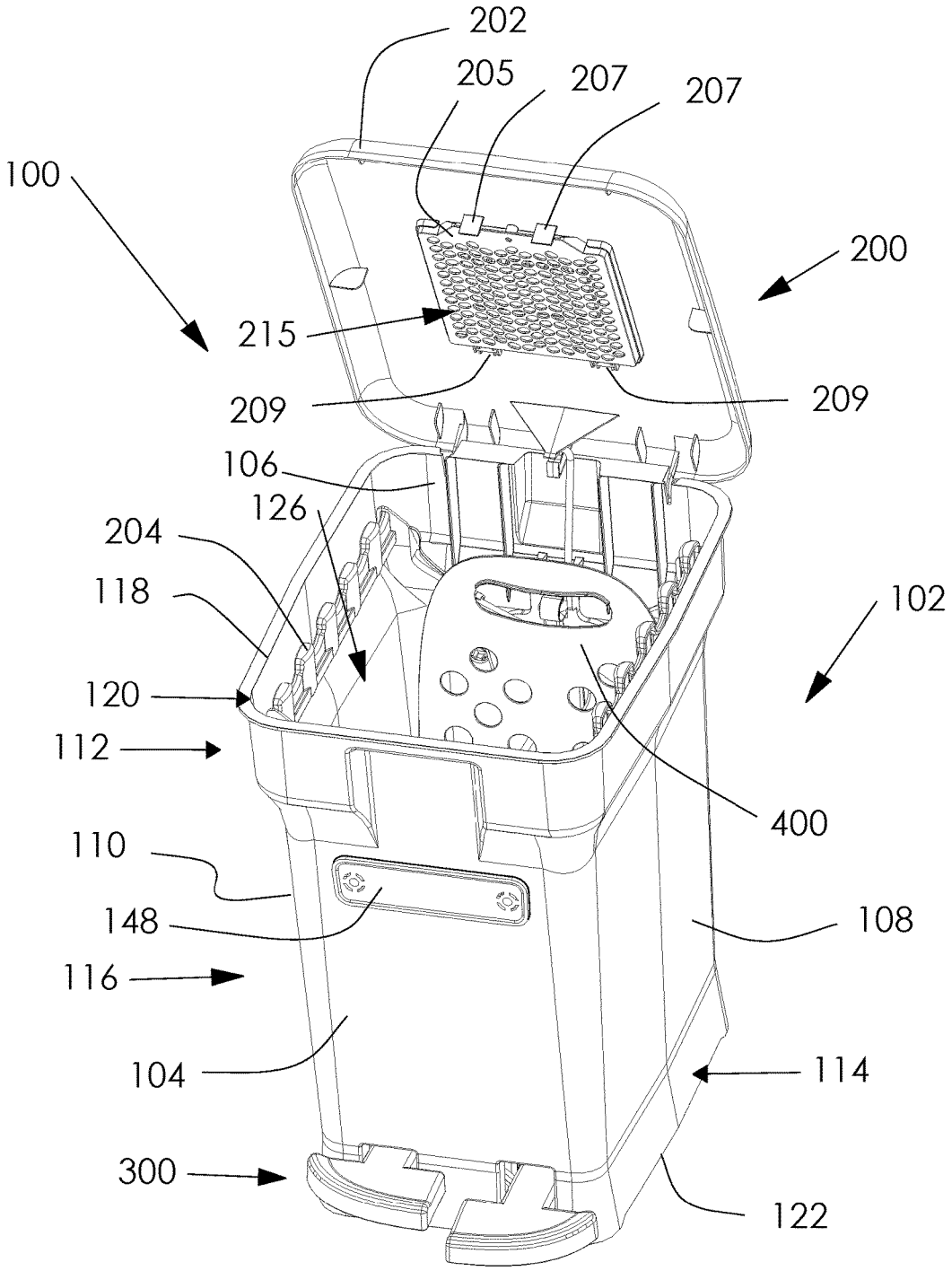
FIG. 1 shows a top perspective view of the receptacle in an open configuration.
Figure 2:
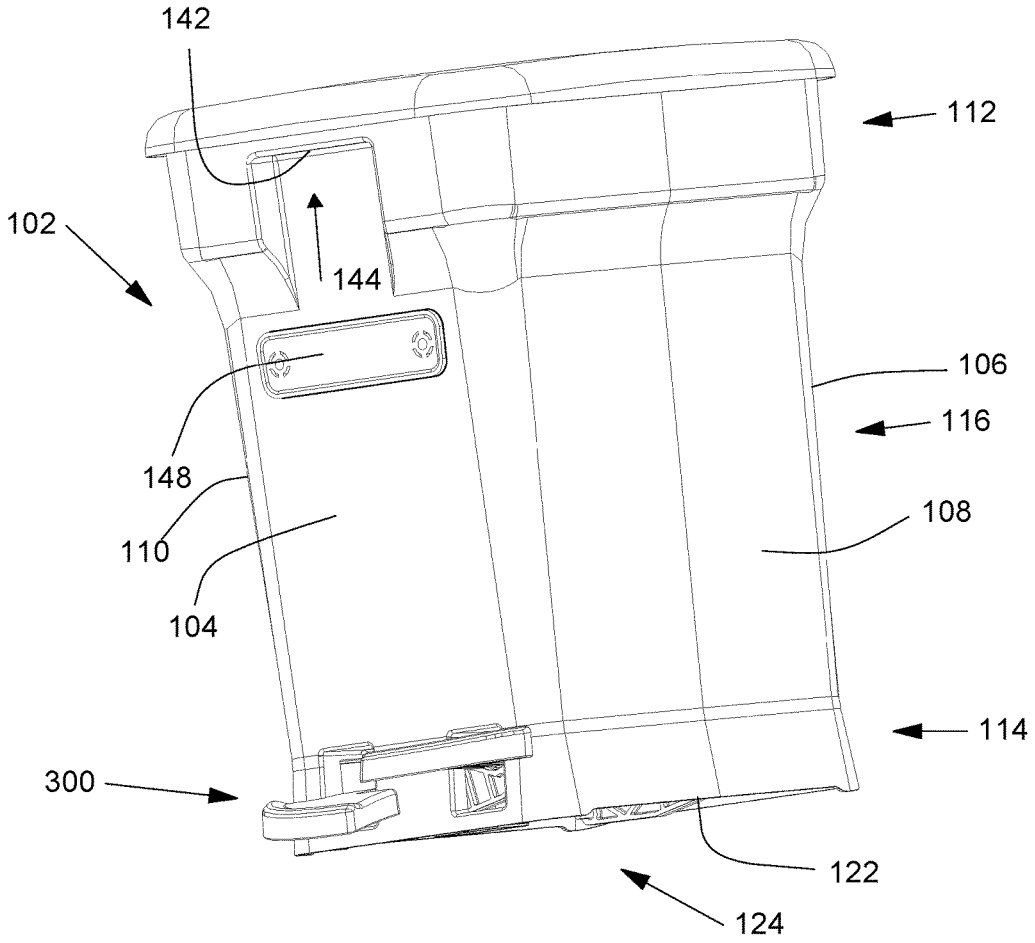
FIG. 2 shows a side perspective view of the receptacle in a closed configuration.

The invention of the present application is directed towards a receptacle 100 that automatically opens and closes an inner lining or bag of the receptacle 100 to facilitate the collection of odorous waste, such as wasted food, pet waste, diapers, ordinary trash, and any other organic, odorous waste. A carrier 400 may also be provided to facilitate the transport of the waste to its desired location. Referring to FIGS. 1 and 2 (perspective view lid open and closed), the receptacle 100 of the present invention comprises a body 102 to house the waste, and a closing system 200 controlled by an actuator system 300 to open and close the receptacle 100.

Body

The body 102 is preferably made of a rigid plastic material suitable for injection molding. The body 102 comprises opposing front and back walls 104, 106, and opposing right and left walls 108, 110 adjacent to front and back walls 104, 106 defining a top portion 112, a bottom portion 114 opposite the top portion 112, and a middle portion 116 therebetween. The front, back, right, and left walls 104, 106, 108, 110 terminate at a top perimeter edge 118 defining a top opening 120 at the top portion 112, and a bottom perimeter edge 122 opposite the top perimeter edge 118, the bottom perimeter edge 122 defining a bottom opening 124 at the bottom portion 114.

Figure 3:
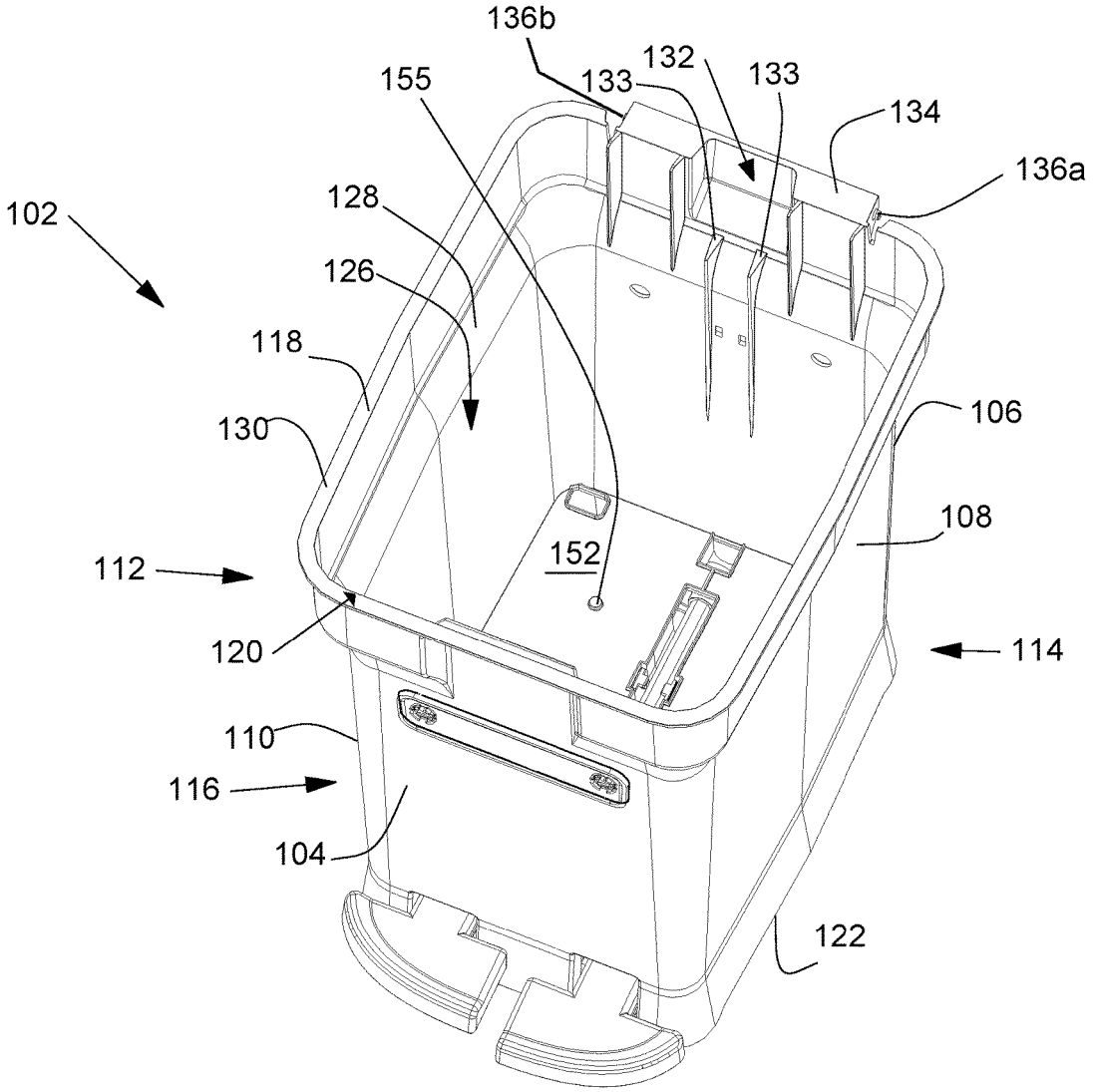
FIG. 3 shows a top perspective view of the receptacle with the closing system removed.

As shown in FIG. 3, the front, back, right, and left walls 104, 106, 108, 110 define a main cavity 126 in the middle portion 116 in which the waste is housed. In the preferred embodiment, as the right and left walls 108, 110 approach the top perimeter edge 118, the right and left walls 108, 110 may expand outwardly creating an interior shelf portion 128 at the top portion 112 of the body 102, thereby creating an opening 120 having a width that is wider than a width of the cavity 126 so that the waste can be easily deposited and removed. The shelf portion 128 provides space for receiving portions of a clamping mechanism 204 in the open position (see FIG. 1) as described further below. On the inner side of the back wall 106 may be two vertical parallel tracks 133 that are bilaterally arranged about the centerline of the back wall 106. Similarly, on the inner side of the front wall 104 may be two vertical parallel tracks 135 (shown in FIG. 18B) that are bilaterally arranged about the centerline of the front wall 104. In some embodiments, the top perimeter edge 118 may comprise a flange 130 extending outwardly for the lid 202 to rest on when closed. In some embodiments, the front and back walls 104, 106 may also expand outwardly to further increase the size of the opening 120 at the top portion 112 so that a depth of the opening 120 is wider than a depth of the cavity 126. In some embodiments, the bottom portion 114 of the body 102 may also expand outwardly as the front and back 104, 106 and/or the right and left 108, 110 walls approach the bottom perimeter edge 122. This provides added stability to the receptacle. The bottom further comprises a base 152 to provide additional support. The base 152 may comprise posts 155 that project into the cavity 126 upon which the carrier 400 may be seated for proper alignment.

The back wall 106 may comprise a recess 132 formed adjacent to the top perimeter edge 118 approximately midway between the right and left walls 108, 110. The back wall 106 may also comprise an extended lip 134 along the top perimeter edge 118. The extended lip 134 allows the lid 202 to be attached to the body 102. In some embodiments, a pair of pins 136*a*, 136*b* project laterally from the extended lip 134. These pins 136*a*, 136*b* can be used for mounting the lid 202 onto the body 102 in a rotatable manner. The recess 132 provides space for components of the closing system 200 to attach to the lid 202 for opening and closing the lid 202, as shown in FIG. 1.

Figure 4:
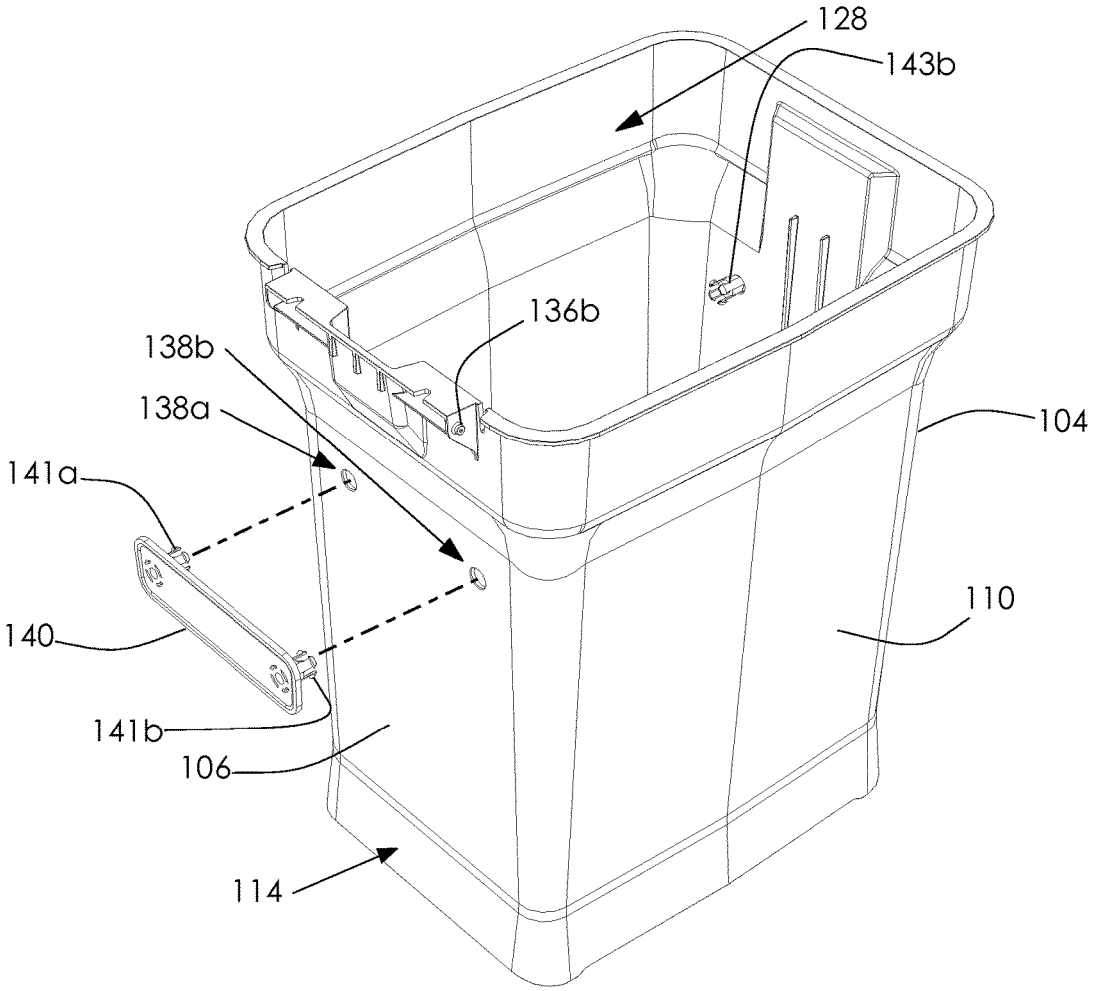
FIG. 4 shows a rear, top perspective view of the body with the placard removed.

As shown in FIG. 4, the back wall 106 may further comprise holes 138*a*, 138*b* for securing the components of the closing system 200 to the body 102. A placard 140 or some other aesthetically pleasing cover, may be used to cover up the holes 138*a*, 138*b* once installation is complete for aesthetic purposes. The placard 140 may have projecting posts 141*a*, 141*b* that are inserted through holes 138*a*, 138*b*, preferably via snap-fit posts, to secure the clamping mechanism 204 to the back wall 106. The holes 138*a*, 138*b* on the back wall 106 are preferably positioned below the shelf portion 128. In some embodiments, the bottom portion 114 of the back wall 106 may comprise additional holes and/or slots for receiving components of the actuator system 300.

Figure 5:
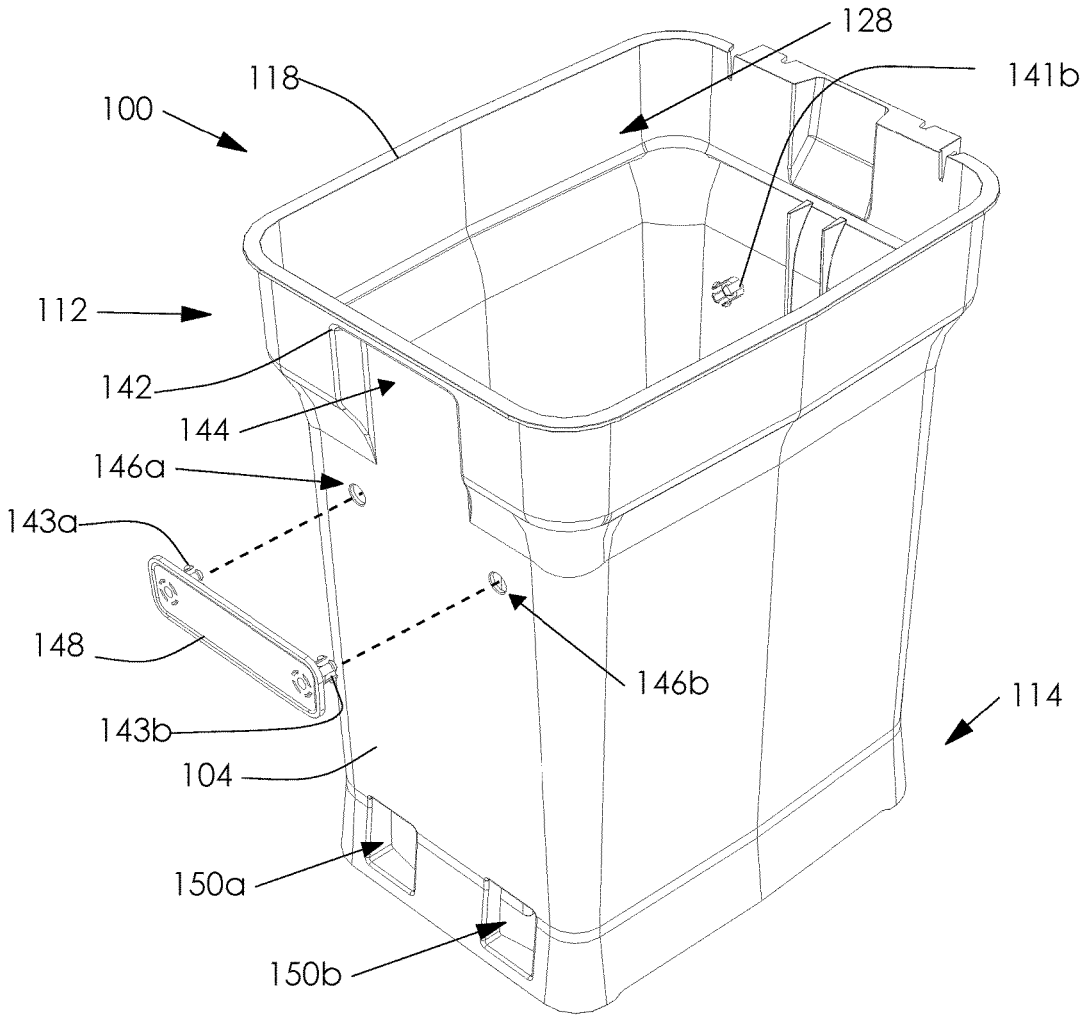
FIG. 5 shows a front, top perspective view of the body.

As shown in FIG. 5, the front wall 104 may comprise a carrying handle 142 for easily lifting the receptacle 100. For example, in one embodiment, the handle 142 is created by an indentation 144 formed just below the top perimeter edge 118 creating a recess within the top portion 112 of the front wall 104. As the indentation 144 approaches the top perimeter edge 118, the front wall 104 may project outwardly creating a ledge that can be used as the handle 142. The front wall 104 may also comprise holes 146*a*, 146*b* for holding components of the closing system 200. A second placard 148 may be used to cover up the holes 146*a*, 146*b* once installation is complete. The second placard 148 may also have projecting posts 143*a*, 143*b* that are inserted through holes 146*a*, 146*b* to secure the clamping mechanism 204 to the front wall 104. The holes 146*a*, 146*b* on the front wall 104 are preferably positioned below the shelf portion 128.

The front wall 104 further comprises a pair of cutouts 150*a*, 150*b* at the bottom portion 114 of the body 102. The cutouts 150*a*, 150*b* may be bilaterally arranged about the centerline of the front wall 104. The cutouts 150*a*, 150*b* are configured to receive components of the actuator system 300 as discussed in detail below.

Figure 6:
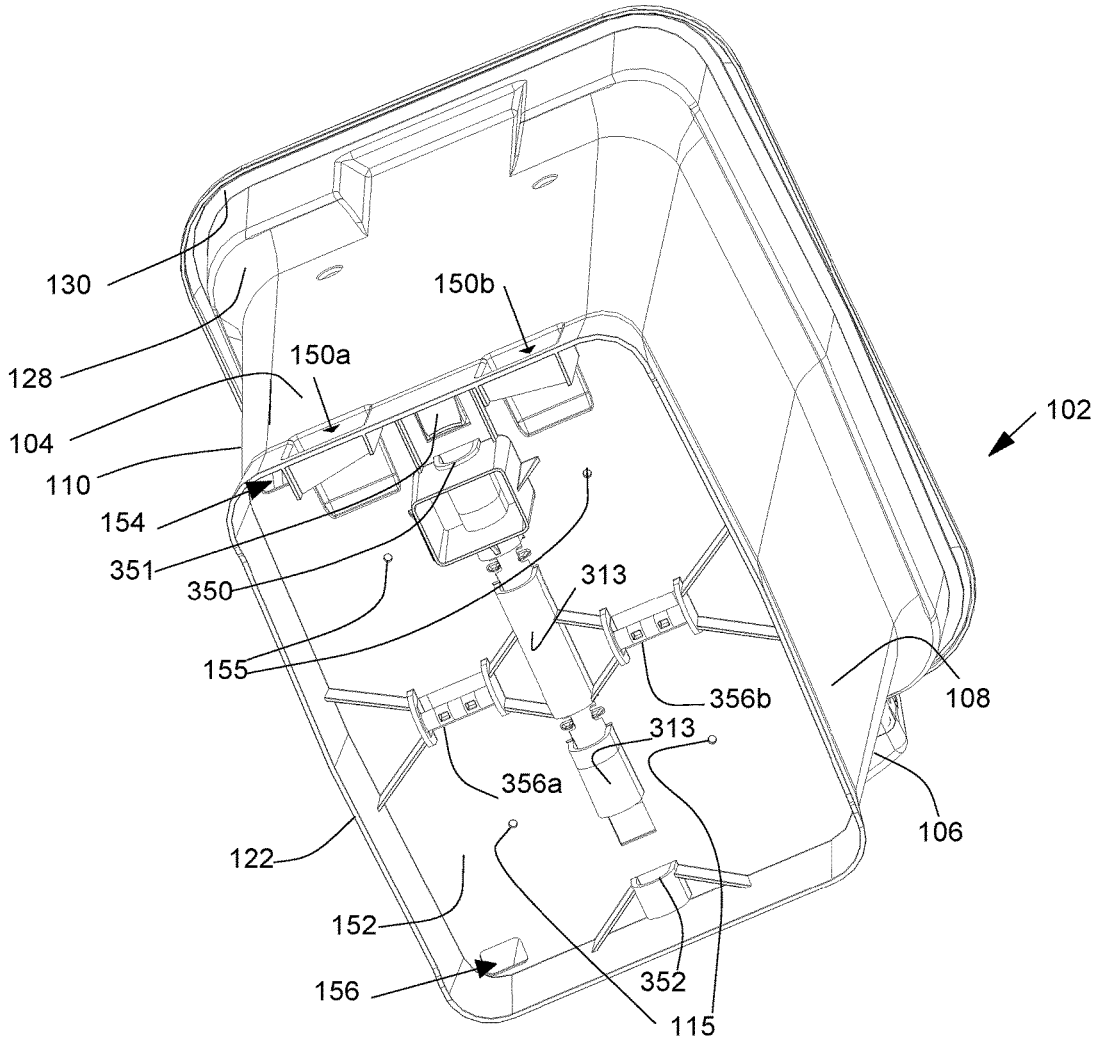
FIG. 6 shows a bottom perspective view of the body.

As shown in FIG. 6, in some embodiments, a base 152 may be positioned at the bottom portion 114 of the body 102 and connected to the front, back, left, and right walls 104, 106, 108, 110. The base 152 provides a floor upon which the inner contents of the receptacle 100 can rest. Preferably, the base 152 is positioned just above the level of the two cutouts 150*a*, 150*b* so as to accommodate the actuator system 300.

The base 152 may comprise a first hole 154 adjacent to the front wall 104 and a second hole 156 opposite the first hole 154 and adjacent to the back wall 106. The first and second holes 154, 156 provide inlets for components of the closing system 200 to enter into the main cavity 126. The base 152 further comprises bushings 350, 352, a stop 351, and cover 313 on the bottom side to hold and/or cover components of the actuator system 300 as described further below. Projecting upwardly onto the top side of the base 152 are a plurality of locating posts 115, 155 that allow the carrier 400 to be secured in place inside the body 102. The carrier 400 may, therefore, have divots on the bottom side to receive these posts 115, 155.

In some embodiments, partitions may extend downwardly from the base 152. The partitions may extend from the front wall 104 to the back wall 106. A first set of partitions may be adjacent to the right wall 108 and a second set of partitions may be adjacent to the left wall 110. The partitions provide additional support to the base 152. In some embodiments, projecting downwardly from the base 152 in between the two sets of partitions is a plurality of posts for mounting the actuator system 300. These posts may be threaded.

Closing System

Figure 7:
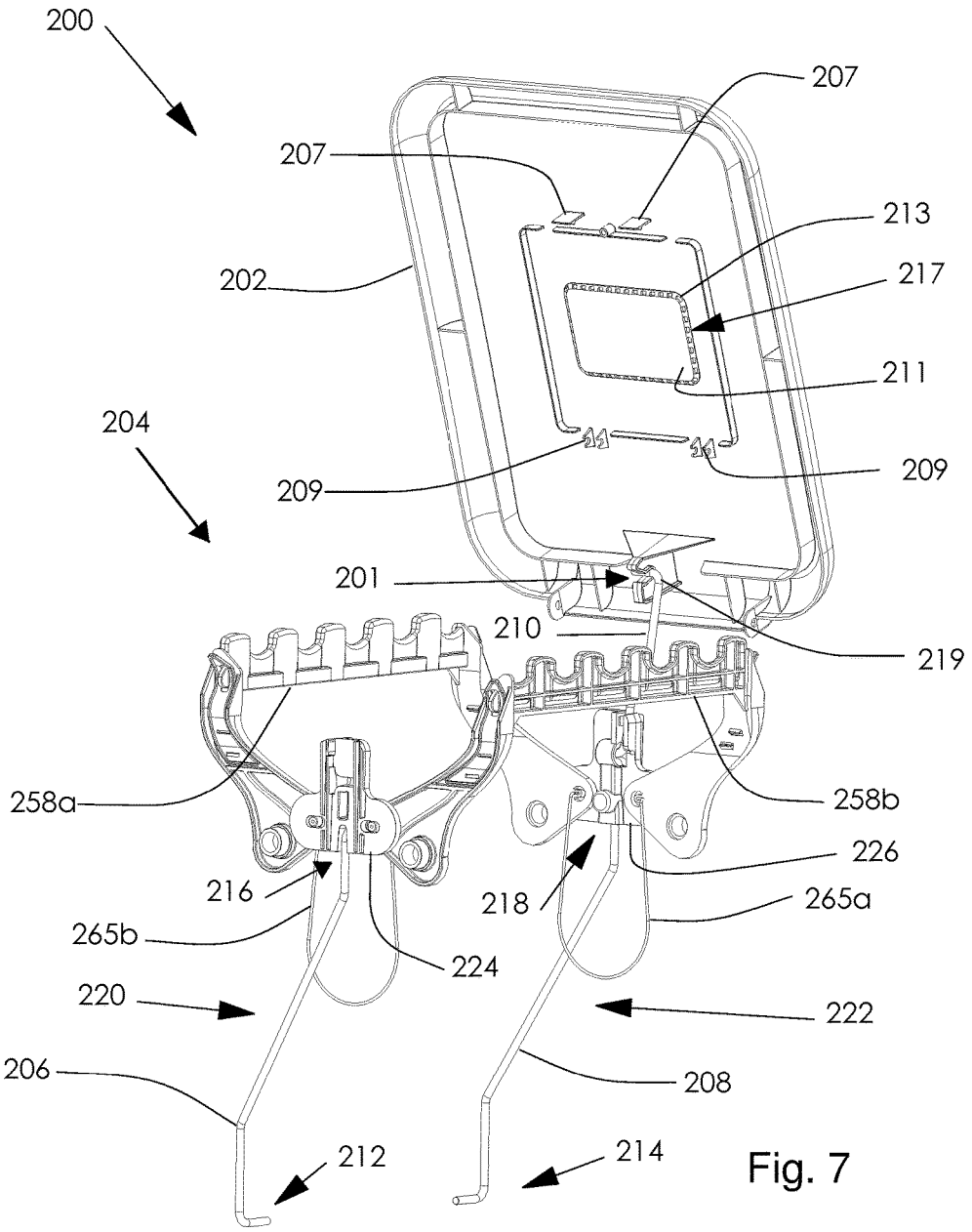
FIG. 7 shows a perspective view of an embodiment of the closing system with a lid in an open position.

As shown in FIG. 7, in some embodiments, the closing system 200 may comprise a lid 202 and a clamping mechanism 204. The closing system 200 may be configured to simultaneously open and close the lid 202 and the clamping mechanism 204.

The back side of the lid 202 comprises an open slot 201 that faces away from the back wall 106 of the body 102. The open slot 201 receives the top end 219 of an extended arm 210 of the clamping mechanism 204 that allows for the lid 202 not only to be lifted or shut simultaneously with the clamping mechanism 204 if activated via the actuator system 300, but also to be lifted or shut independently without opening or closing the clamping mechanism 204. Thus, the open slot 201 allows the lid to disengage from the actuator system 300.

The lid 202 may have a ventilation system that comprises a vent 213. In the preferred embodiment, the vent 213 may not be in line with the surface of the lid 202 so as to slightly elevate or depress a portion 211 of the lid 202 relative to the remaining surface of the lid 202. The vent 213 contain at least two holes 217, allowing for air ventilation. The lid may also comprise a perforated flap 205 (shown in FIG. 1) with a multitude of holes 215 that may be hinged to the lid 202. In the preferred embodiment, the perforated flap 205 may swivel and rotate around two hinged joints 209 on the lid 202 and may be removably secured onto the lid 202 via two hooks 207 on the lid 202. A filter (not shown) may be housed in between the lid 202 and flap 205. For example, an activated charcoal filter may be inserted in between the perforated flap 205 and the lid 202 to control odor created by the waste in the receptacle 100.

The clamping mechanism 204 comprises a front lift arm 206 adjacent to the front wall 104 of the body 102 and a back lift arm 208 adjacent to the back wall 106 of the body 102. The front and back lift arms 206, 208 are substantially similar with one major difference being that the back lift arm 208 further comprises an extended arm 210 that attaches to the lid 202 or a hand actuator 301 as discussed below.

Both lift arms 206, 208 comprise a bottom end 212, 214, a top end 216, 218 opposite the bottom end 212, 214, and a bent post 220, 222 extending therebetween, respectively. The bottom ends 212, 214 are configured to attach to components of the actuator system 300. By way of example only, the lift arms 206, 208 are made from cylindrical rods. Therefore, the bottom ends 212, 214 may terminate as pins that can be inserted into a hole of a component of the actuator system 300 to connect to the actuator system 300 as discussed below.

The bent posts 220, 222 allow their respective bottom ends 212, 214 to be positioned adjacent to one of the side walls (in this example, the left wall 110) while allowing their respective top ends 216, 218 to align with the center line of the front and back wall 104, 106, respectively. Therefore, when properly installed the front and back lift arms 206, 208 extend upwardly from their respective bottom ends 212, 214, then bend towards the centerlines of the front and back walls 104, 106, respectively, then continue extending upwardly along their respective centerlines, terminating at their respective top ends 216, 218 centrally located between the right and left walls 108, 110. Each top end 216, 218 of the lift arm 206, 208 is operatively connected to their respective clamp actuator (front and back clamp actuators 224, 226).

The extension arm 210 may continue upwardly until a top end 219 of the extension arm 210 meets the back portion of the lid 202. The extension arm 210 may be attached to or abuttable against the back portion of the lid 202. The back portion of the lid 202 is rotatably attached to the back wall 106 of the body 102 via the pins 136*a*, 136*b*. In some embodiments, the extension arm 210 is slightly tilted towards the back wall 106. When actuated to lift upwardly, the extension arm 210 applies pressure against the back portion of the lid 202. In some embodiments, the pressure is an upward and rearward force. This causes the back portion of the lid 202 to rotate about the axis defined by the pins 136*a*, 136*b*. Rotation about this axis causes front portion of the lid 202 to rise up into the open configuration. In some embodiments, the clamp actuators 224, 226 may be integrally formed with their respective lift arms 206, 208. As the lift arms 206, 208 move up and down from movement of the actuator system 300, the clamp actuators 224, 226 similarly move up and down, thereby opening and closing the clamping mechanism 205 as discussed below.

Figure 8:
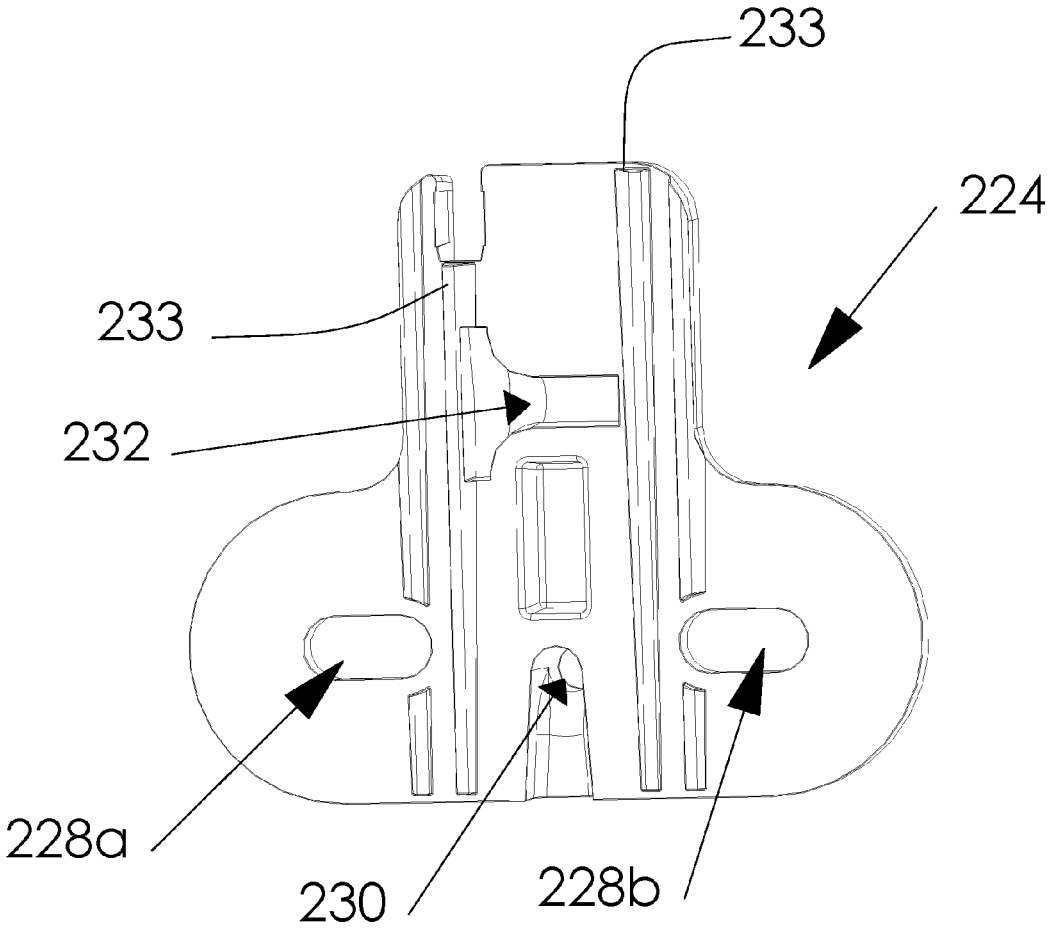
FIG. 8 shows a perspective view of a clamp actuator.

In the preferred embodiment, movement of the clamp bars 258*a*, 258*b* are controlled by the clamp actuators 224, 226. The front and back clamp actuators 224, 226 may be identical. Therefore, only the front clamp actuator is described below, but the description is applicable to the back clamp actuator 226 as well. As shown in FIG. 8, the clamp actuator 224 is a flat plate having two bilaterally arranged horizontal slots 228*a*, 228*b*. In between the horizontal slots is a center hole 230. The center hole 230 is configured to receive the top ends 216, 218 of the lift arms 206, 208. Above the center hole 230 is a center slot 232. The center slot 232 is configured to receive the bottom end of the extension arm 210. There may be two parallel vertical rails 233 that are bilaterally arranged about the center hole 230 of the clamp actuator 224. The distance between the two parallel vertical rails 233 are configured to slide along the two vertical parallel tracks 135 on the front wall 104 or the two vertical parallel tracks 133 on the back wall 106 of the body 102. In the preferred embodiment, the horizontal slots 228*a*, 228*b* are on the outsides of the two parallel vertical rails 233 and the center hole 230 and center slot 232 are in between the two parallel vertical rails 233.

Figure 9:
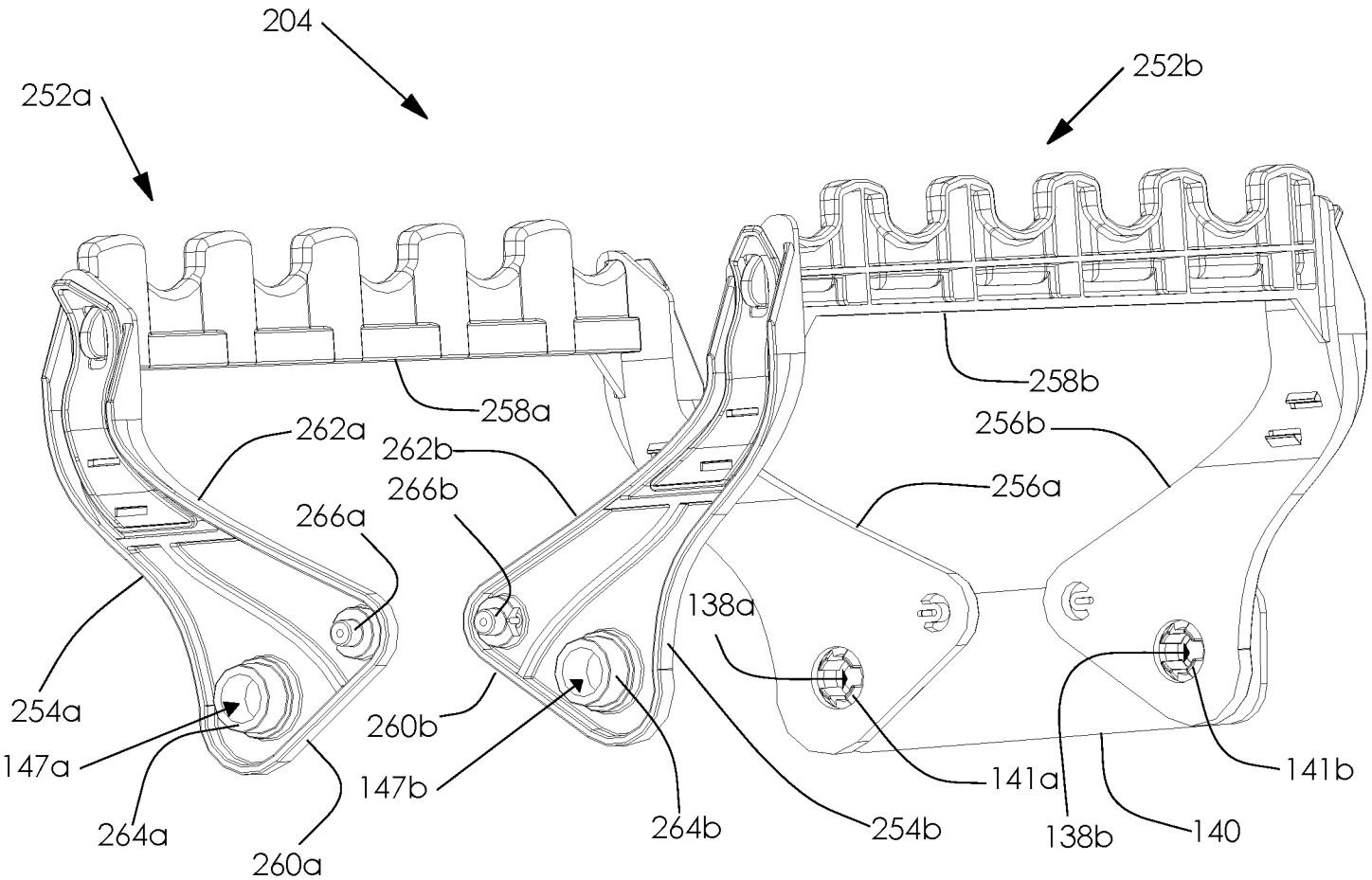
FIG. 9 shows a front perspective view of the clamp arms in an open position.
Figure 10:
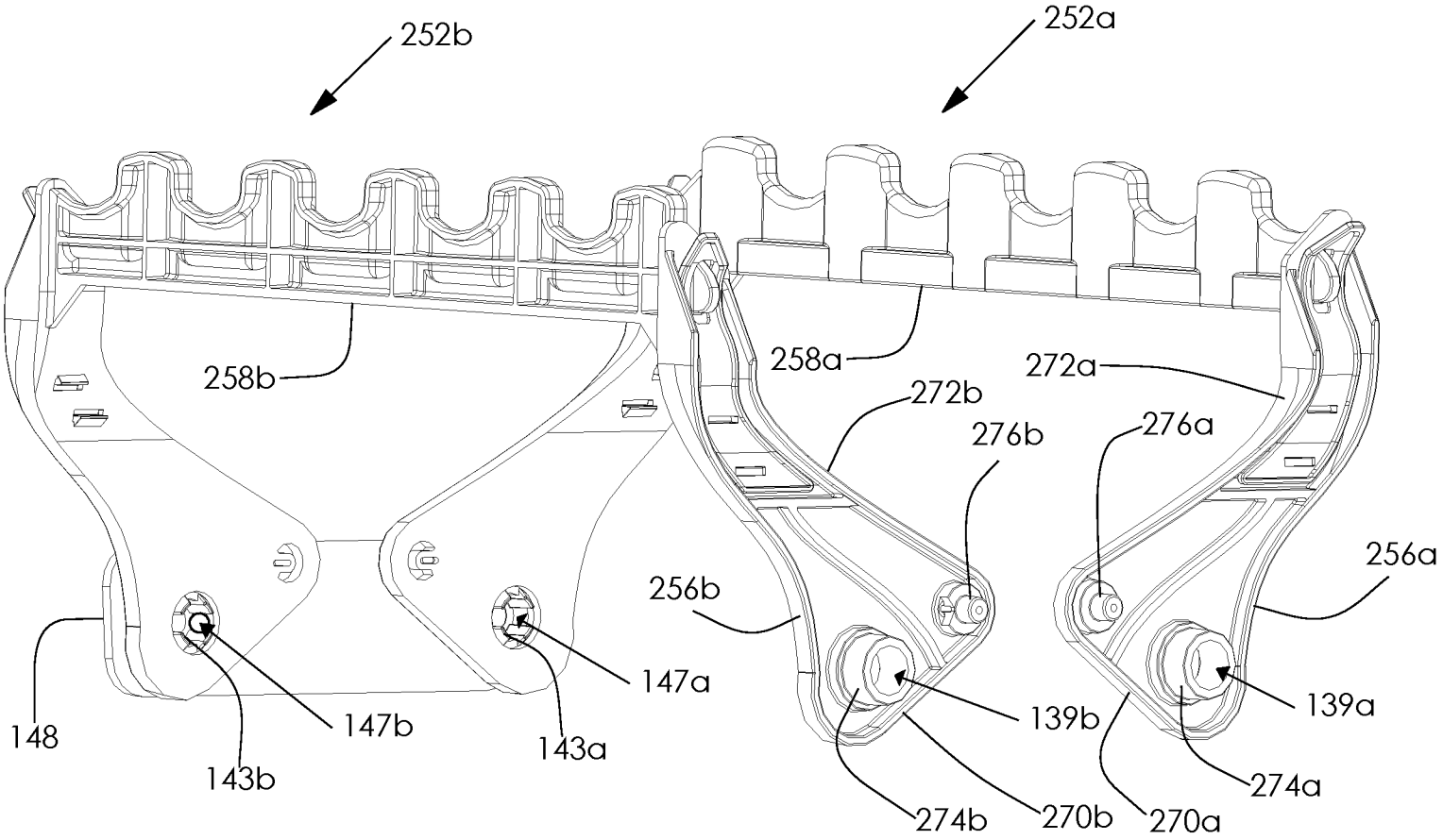
FIG. 10 shows a rear perspective view of the clamp arms in an open position.

As shown in FIGS. 9 and 10, the clamping mechanism 204 comprises a pair of clamp arms 252*a*, 252*b*. FIG. 9 shows a front perspective view of the clamp arms 252*a*, 252*b* and FIG. 10 shows the rear perspective view. Each clamp arm 252*a*, 252*b* comprises a front arm 254*a*, 254*b*, a back arm 256*a*, 256*b*, and a clamp bar 258*a*, 258*b* therebetween operatively connected to the front arms 254*a*, 254*b* and back 256*a*, 256*b* arms, respectively. Each front arm 254*a*, 254*b* has a transverse base 260*a*, 260*b*, with an upwardly projecting connector arm 262*a*, 262*b*, respectively. Each connector arms 262*a*, 262*b* is connected to each clamp bar 258*a*, 258*b*, respectively, thereby positioning the transverse bases 260*a*, 260*b* below the clamp bars 258*a*, 258*b*. Each transverse base 260*a*, 260*b* comprises a lateral peg 264*a*, 264*b* and a central peg 266*a*, 266*b* at opposite ends of their respective transverse base 260*a*, 260*b*. Each lateral peg 264*a*, 264*b* is positioned laterally closer to the left or right wall 110, 108, respectively. Each central peg 266*a*, 266*b* is positioned inwardly towards the centerline of the front and back walls 104, 106.

The front arms 254*a*, 254*b* are attached to the front wall 104 via their lateral pegs 264*a*, 264*b*. The lateral pegs 264*a*, 264*b* extend forwardly toward the front wall 104 from their respective transverse bases 260*a*, 260*b*. These lateral pegs 264*a*, 264*b* may fit into their respective holes 146*a*, 146*b* on the front wall 104 (shown in FIG. 5) so that the clamp arms 252*a*, 252*b* can be mounted on the body 102. Alternatively, or in addition to, the lateral pegs 264*a*, 264*b* may have holes 147*a*, 147*b* into which the posts 143*a*, 143*b* of the front placard 148 can be inserted to secure the clamp arms 252*a*, 252*b* to the front wall 104. The lateral pegs 264*a*, 264*b* are cylindrical so as to be rotatable within the holes 146*a*, 146*b* and/or about the posts 143*a*, 143*b*. Being fixed yet rotatable, these lateral pegs 264*a*, 264*b* become hinge points about which their respective clamp arms 252*a*, 252*b* can rotate.

The central pegs 266*a*, 266*b* fit inside the horizontal slots 228*a*, 228*b* of the clamp actuator 224, on their respective sides, in a slidable manner. Thus, the central pegs 266*a*,

266*b* are configured to slide back and forth within their respective horizontal slots 228*a*, 228*b*.

Similarly, with reference to FIG. 10, each back arm 256*a*, 256*b*, respectively, has a transverse base 270*a*, 270*b* with an upwardly projecting connector arm 272*a*, 272*b*. Each connector arm 272*a*, 272*b* is connected to the clamp bar 258*a*, 258*b*, respectively, thereby positioning the transverse bases 270*a*, 270*b* below the clamp bars 258*a*, 258*b*. Each transverse base 270*a*, 270*b* comprises a lateral peg 274*a*, 274*b* and a central peg 276*a*, 276*b* at opposite ends of their respective transverse base 270*a*, 270*b*. Each lateral peg 274*a*, 274*b* is positioned laterally closer to the left or right wall 110, 108, respectively. Each central peg 276*a*, 276*b* is positioned inwardly towards the centerline of the front and back walls 104, 106, respectively.

The back arms 256*a*, 256*b* are attached to the back wall 106 via their lateral pegs 274*a*, 274*b* similar to the way the front arms 254*a*, 254*b* are attached to the front wall 104. The lateral pegs 274*a*, 274*b* extend rearwardly toward the back wall 106 from their respective transverse bases 270*a*, 270*b*. These lateral pegs 274*a*, 274*b* may have holes 139*a*, 139*b* into which the posts 141*a*, 141*b* of the back placard 140 can be inserted to secure the clamp arms 252*a*, 252*b* to the back wall 106. The lateral pegs 274*a*, 274*b* are cylindrical so as to be rotatable within the holes 138*a*, 138*b* on the back wall 106 and/or about the posts 141*a*, 141*b*. Being fixed yet rotatable, these lateral pegs 274*a*, 274*b* become hinge points about which their respective clamp arms 252*a*, 252*b* can rotate.

The central pegs 276*a*, 276*b*, like the central pegs 266*a*, 266*b* of the front arm 254*a*, 254*b*, fit inside the horizontal slots 228*a*, 228*b* of the clamp actuator 226, on their respective sides, in a slidable manner, and are configured to slide back and forth within their respective horizontal slots 228*a*, 228*b*. Thus, as the clamp arms 252*a*, 252*b* move from the open and closed positions about their respective hinge points, the central pegs 276*a*, 276*b* slide within their respective horizontal slots 228*a*, 228*b* to accommodate such movements.

Figure 11:
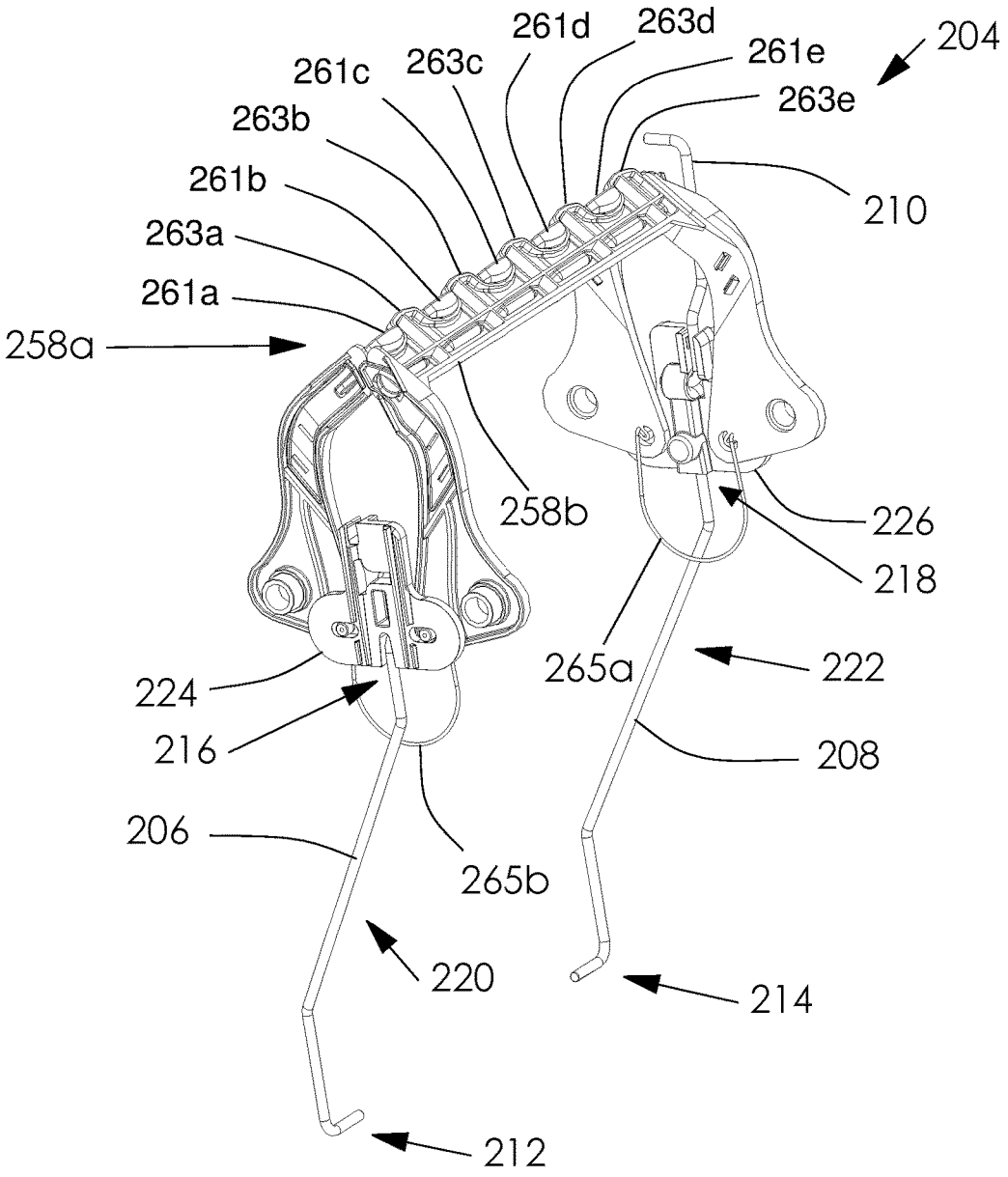
FIG. 11 shows a front perspective view of the clamping mechanism in a closed position.

As shown in FIG. 11, the clamp bars 258*a*, 258*b* are configured to mate with each other when in the closed configuration. In the preferred embodiment, the clamp bars 258*a*, 258*b* may have a plurality of fingers 261*a-e*, 263*a-e* that can interlock with each other when in the closed configuration such that a finger (e.g. 261*b*) on one clamp bar 258*a* fits in between two fingers (e.g. 263*a*, 263*b*) on the opposite clamp bar 258*b*. In some embodiments, the clamp bars 258*a*, 258*b* may have alternating horizontal strips that mate with each other like a zip locking bag. The horizontal strips may extend across the entire length of their respective clamp bar. In some embodiments, the clamp bars 258*a*, 258*b* may have an adhesive strip that allows a plastic bag placed in between the clamp bars 258*a*, 258*b* to adhere to the clamp bars 258*a*, 258*b*. In other embodiments, the clamp bars 258*a*, 258*b* may have an adhesive or tacky silicone applied to the fingers 261*a-e*, 263*a-e* and/or ends of the clamp bars 258*a*, 258*b*. The adhesives or tacky silicone help keep a liner or bag attached to the clamp bars 258*a*, 258*b* while the clamp bars 258*a*, 258*b* are opened or closed.

Figure 12:
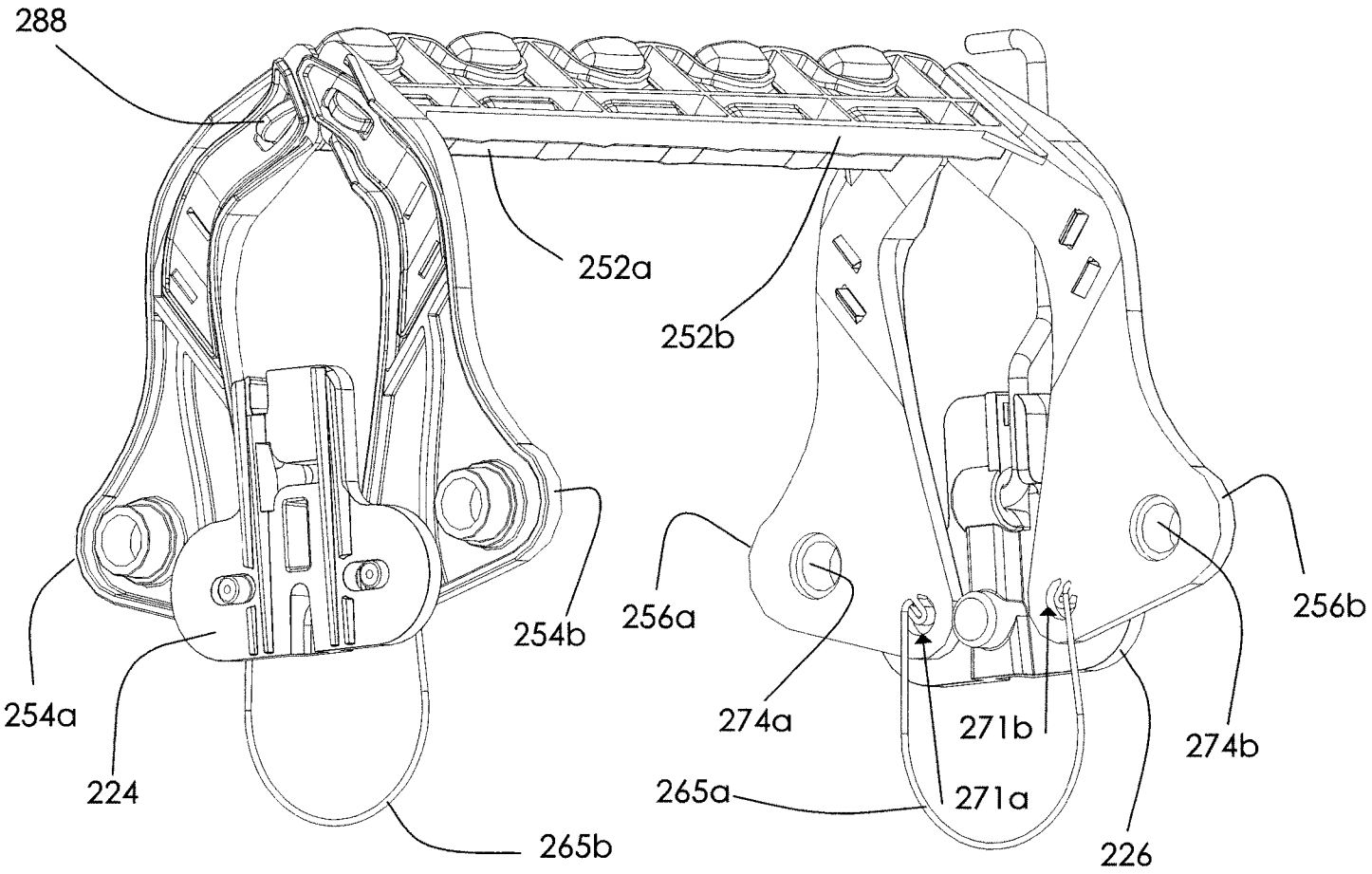
FIG. 12 shows a front perspective view of a clamp arms in a closed position with the spring in place.
Figure 13:
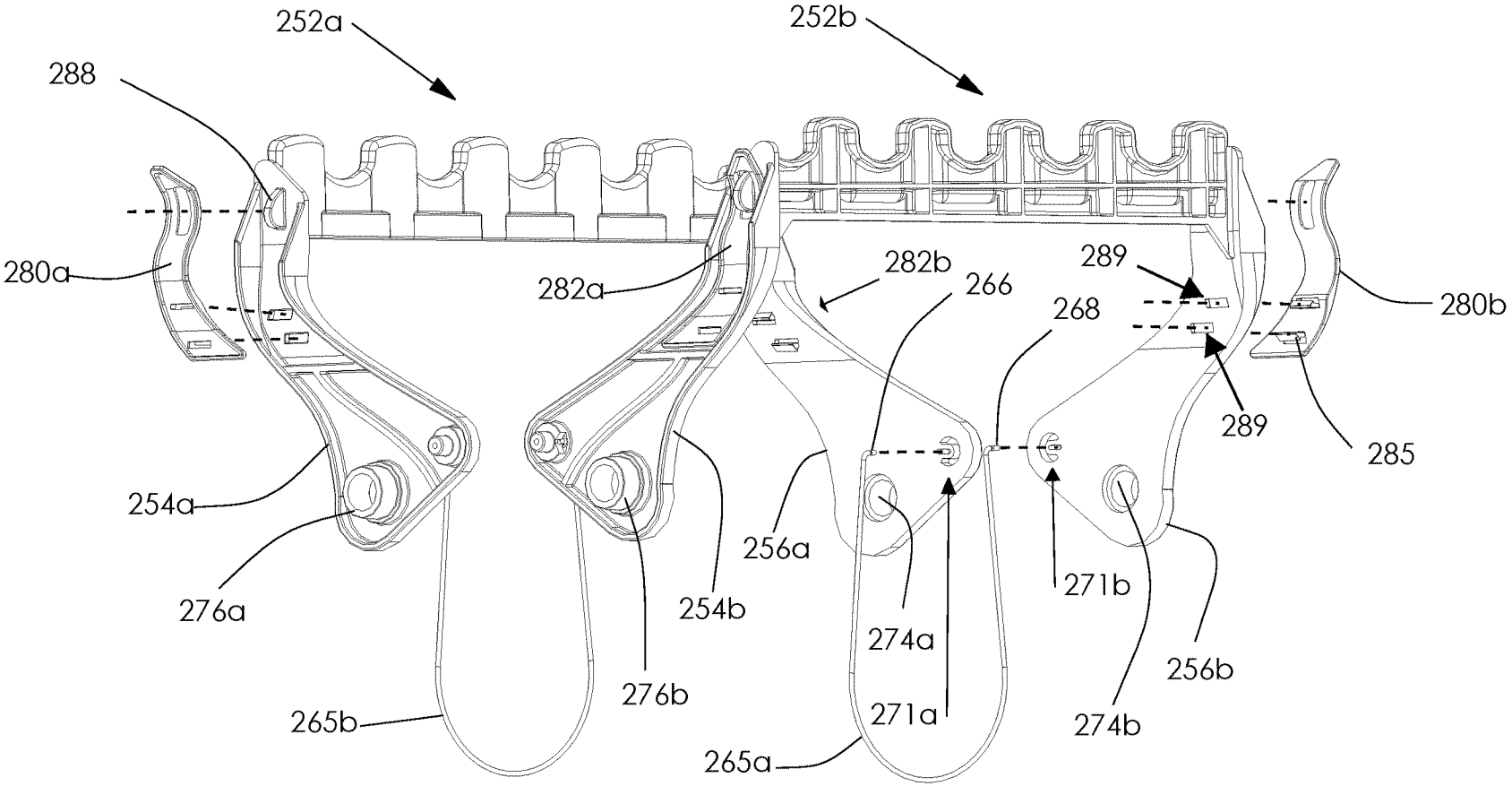
FIG. 13 shows a partial exploded view of a front perspective view of the clamp arms in an open position with the spring removed.

In some embodiments, as shown in FIGS. 12 and 13, one or more springs 265*a*, 265*b* may be used to keep the clamp arms 252*a*, 252*b* in the open or closed configuration. The springs 265*a*, 265*b* can be attached to the front arms 254*a*, 254*b* and/or back arms 256*a*, 256*b* in such a way as to create a laterally-directed biasing force (i.e. towards the left and right walls). Due to the positioning of the spring and the rotational movement of the clamp arms 252*a*, 252*b*, the laterally-directed biasing force will keep the lid 202 and the clamping mechanism 204 open when in the open configuration, and it will keep the clamping mechanism 204 closed when the clamping mechanism 204 is in the closed configuration.

The springs 265*a*, 265*b* may be identical; therefore, for convenience only, one spring 265*a* will be described. By way of example only, the spring 265*a* may be an elongated rod that is flexible enough to bend, but also has elastic properties to naturally tend toward a straightened configuration. The spring 265*a* may have free ends 266, 268 bent into hook-like configurations so as to be secured to opposing front arms 254*a*, 254*b* or opposing back arms 256*a*, 256*b*. FIG. 12 shows the spring 265*a* attached to opposing back arms 256*a*, 256*b*. The back arms 256*a*, 256*b* are configured to have holes and/or slots 271*a*, 271*b* to receive the free ends 266, 268 of spring 265 on opposite sides. The holes/slots 271*a*, 271*b* are positioned medially relative to the pivot points (i.e. lateral pegs 274*a*, 274*b*). In the preferred embodiment, the holes/slots 271*a*, 271*b* may be a circular hole and/or a crescent-shaped slot. As shown in FIG. 12, when the clamp arms 252*a*, 252*b* are in the closed configuration, the holes/slots 271*a*, 271*b* are below the pivot points. As shown in FIG. 13, when the clamp arms 252*a*, 252*b* are in the open configuration, the holes/slots 271*a*, 271*b* are above the pivot points. The distance between the holes/slots 271*a*, 271*b* receiving the spring 265*a* is less than the length of spring 265*a*. Therefore, the spring 265*a* may be bent into a U-shaped configuration for the free ends 266, 268 to be inserted into the holes/slots 271*a*, 271*b*, respectively.

In this configuration, the elastic properties of the spring 265*a* will urge the free ends 266, 268 away from each other. When the clamp arms 252*a*, 252*b* are in the closed configuration, the free ends 266, 268 are below the pivot points. Therefore, urging the free ends 266, 268 away from each other causes the free ends 266, 268 to move under the pivot point thereby causing one clamp arm to rotate in the clockwise direction (in this example the left clamp arm 252*a*) and the other clamp arm to rotate in the counterclockwise direction (in this example the right clamp arm 252*b*), thereby urging the clamp arms 252*a*, 252*b* to be in the clamped configuration.

When the clamp arms 252*a*, 252*b* are in the open configuration, the free ends 266, 268 rotate to a position above the pivot points. Therefore, urging the free ends 266, 268 away from each other causes one clamp arm to rotate in the counterclockwise direction (in this example, the left clamp arm 252*a*) and the other clamp arm to rotate in the clockwise direction (in this example, the right clamp arm 252*b*), thereby urging the clamp arms 252*a*, 252*b* to be in the opened configuration. This spring 265*a* can be applied to the back arms 256*a*, 256*b*, front arms 254*a*, 254*b*, or both. Other mechanisms for urging the medial ends outwardly above and below the lateral pegs can be used, including tension springs, compression springs, and the like.

Figure 14:
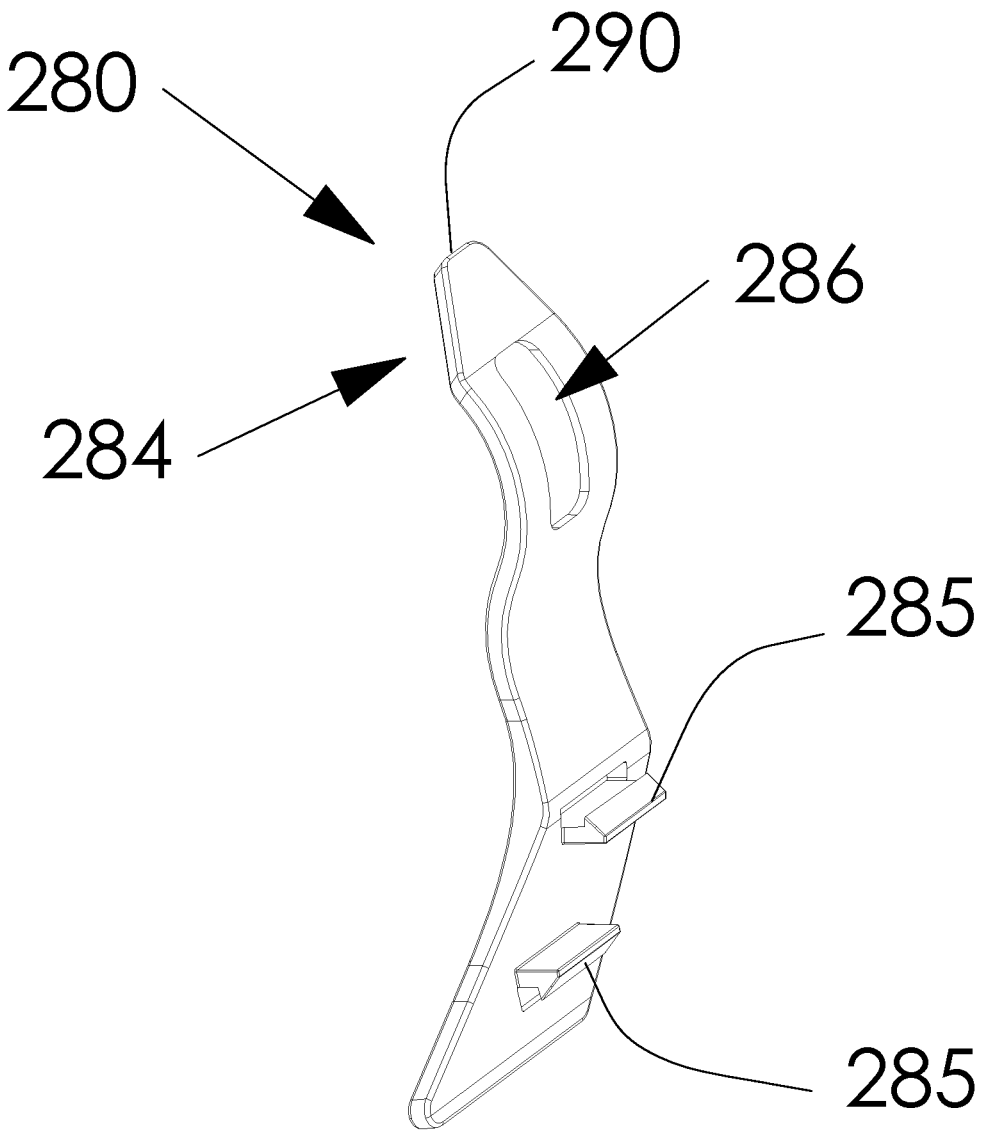
FIG. 14 shows a perspective view of a bag clip.

In some embodiments, bag clips 280*a*, 282*a* may be used to secure the bag to the clamp arms 252*a*, 252*b*. The bag clips 280*a*, 282*a* on opposing front arms 254*a*, 254*b* are mirror images of each other, but otherwise have the same structural features. Additional bag clips 280*b*, 282*b* are identical to bag clips 280*a*, 282*a*, respectively, can be used on the appropriate back arms 256*b*, 256*a*. For the sake of convenience, only one bag clip 280*a* and the front arm 254*a* will be described, but the features described apply to any of the bag clips 280*a*, 280*b*, 282*a*, 282*b* and their respective arms 254*a*, 256*a*, 254*b*, 256*b*. As shown in FIG. 14, the bag clip 280 is designed to snap on to the front arms 254*a*, 254*b* or back arms 256*a*, 256*b*. To that effect, the bag clip 280 may comprise clip arms 285 to snap onto the front arms 254*a*, 254*b* or back arms 256*a*, 256*b*. The clip arms 285 may clip on to the side of the front or back arms, or through a slit 289 in the front or back arms. A top portion 284 of the bag clip 280 may comprise a slot 286 through which a protuberance 288 on the front or back arm can be inserted. The bag clip 280 may have some elasticity so that when the top portion 284 is pulled away from the front arm 254*a*, the top portion 284 may flex away from the front arm 254*a* without snapping off. Portions of a bag inserted in between the bag clip 280 and the front arm 254*a*, for example, would be locked in when the bag clip 280 is released and snapped back towards the front arm 254*a* with the bag inserted in between the protuberance 288 and the slot 284. To facilitate pulling the top portion 284 of the bag clip 280 away from the front arm 254*a*, the top portion 284 may have a puckered lip 290 that bends away from the front arm 254*a* so as to create a handle to grab. Any other way for creating a gap between the top portion 284 and the front arm 254*a* can be used so that the user can have a convenient place to pull the bag clip 280 away from the front arm 254*a*.

In some embodiments, a lock may be provided to keep the lid 202 in the open configuration while the user is able to collect the waste for deposit into the receptacle 100 without having to maintain pressure on the pedal.

The Actuator System

The actuator system 300 is operatively connected to the closing system 200 so that the actuator system 300 can open and close the closing system 200.

Figure 15:
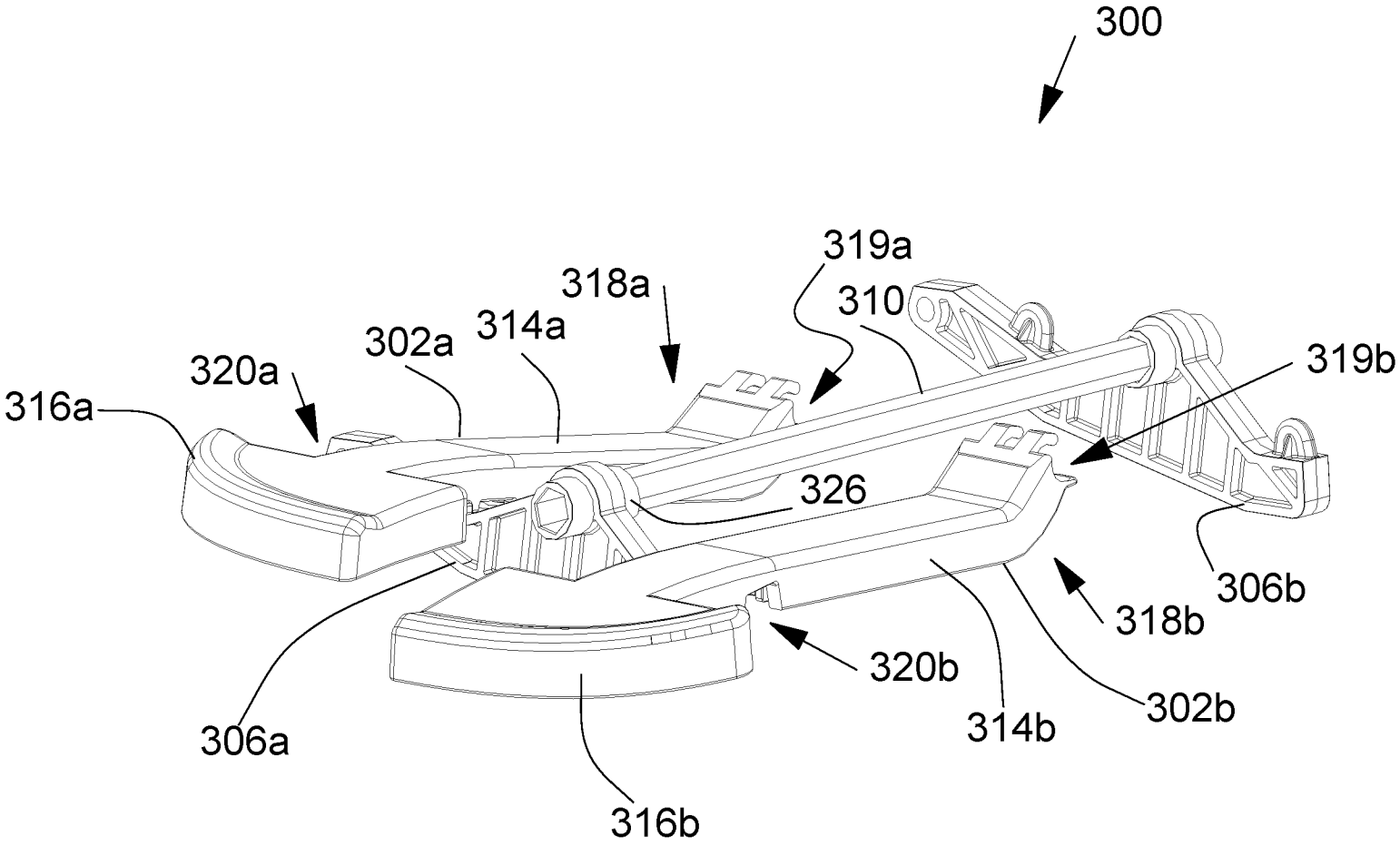
FIG. 15 shows a front perspective view of the actuator system.
Figure 16:
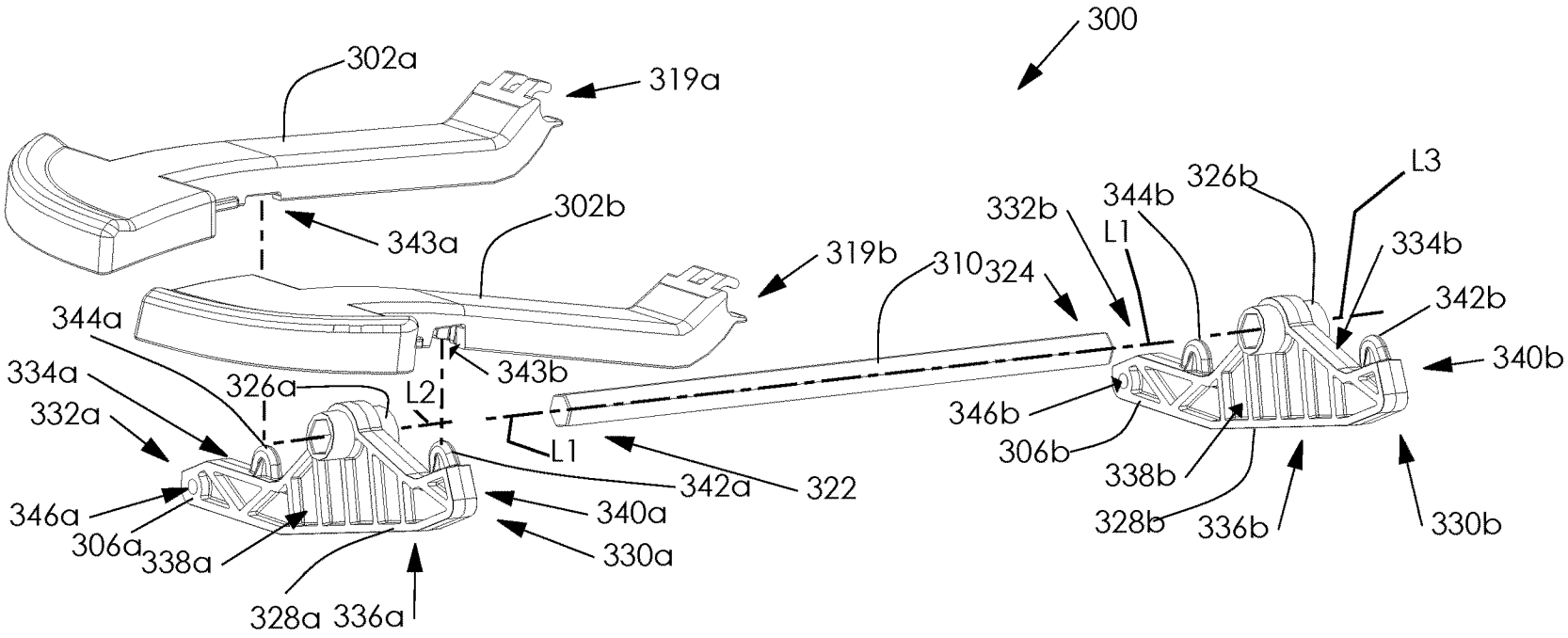
FIG. 16 shows an exploded view of the actuator system.

In the preferred embodiment, as shown in FIGS. 15 and 16, the actuator system 300 comprises a pair of pedal levers 302*a*, 302*b*, a pair of rocker arms (front rocker arm 306*a* and back rocker arm 306*b*), and an axle 310 connecting the rocker arms 306*a*, 306*b*. The actuator system 300 is used to control the closing system 200. Whenever the lid 202 is closed by the actuator system 300, the clamping mechanism 204 is closed by the actuator system 300, and when the lid 202 is opened by the actuator system 300, the clamping mechanism 204 is opened by the actuator system 300. The two pedal levers 302*a*, 302*b* may be mirror images of each other arranged bilaterally adjacent to each other. Each pedal lever 302*a*, 302*b* comprises a lever arm 314*a*, 314*b* and a pedal 316*a*, 316*b*. The lever arms 314*a*, 314*b* each have a proximal end 318*a*, 318*b* and a distal end 320*a*, 320*b*. Each proximal end 318*a*, 318*b* of the lever arm 314*a*, 314*b* comprises a c-shaped opening 319*a*, 319*b* that connects to the base 152 as discussed below. The pedals 316*a*, 316*b* provide a convenient stepping surface for the user to apply pressure with his or her feet to depress the pedal 316*a*, 316*b* accordingly.

As shown in FIG. 16, the axle 310 may be an elongated member defining a longitudinal axis L1 having a forward end 322 and a rearward end 324. The forward end 322 of the axle 310 is configured to receive the front rocker arm 306*a*, and rearward end 324 of the axle 310 is configured to receive the back rocker arm 306*b*. In some embodiments, the axle 310 may be faceted. For example, the axle 310 may be hexagonal in shape to facilitate the rocking movement of the arms 306*a*, 306*b*. The axle 310 is positioned in between the two pedal levers 302*a*, 302*b*.

In the preferred embodiment, the front and back rocker arms 306*a*, 306*b* are identical. The front rocker arm 306*a* performs a seesaw or rocking action to rotate the axle 310 about its longitudinal axis L1 in a clockwise and counterclockwise fashion. The front rocker arm 306*a* comprises a front socket 326*a* defining a longitudinal axis L2. The front socket 326*a* is configured to receive the forward end 322 of the axle 310 so that the longitudinal axis L2 of the front socket 326*a* is coaxially aligned with the longitudinal axis L1 of the axle 310. The outer surface of the axle 310 is configured to mate with the inner surface of the front socket 326*a* such that rotation of the front socket 326*a* about its longitudinal axis L2 causes rotation of the axle 310 about its longitudinal axis L1. For example, in the preferred embodiment, the outer surface of the axle 310 and the inner surface of the front socket 326*a* may have a hexagonal cross section of substantially the same size.

Extending bilaterally away from the front socket 326*a* approximately perpendicularly to the longitudinal axis L2 of the socket 326*a* is a front support arm 328*a* terminating at opposite terminal ends 330*a*, 332*a*. The front support arm 328*a* has a top edge 334*a*, a bottom edge 336*a* opposite the top edge 334*a*, a front face 338*a* adjacent to the top and bottom edges, and a back face 340*a* opposite the front face and adjacent to the top and bottom edges. The front socket 326*a* may protrude forwardly and/or rearwardly away from the front and/or back faces 338*a*, 340*a* of the front support arm 328*a* so as to jut out from the front and/or back face 338*a*, 340*a*. The top edge 334*a* comprises two connectors 342*a*, 344*a* to allow the support arm 328*a* to operatively connect with reciprocal connectors 343*a*, 343*b* on their respective pedal levers 302*a*, 302*b* at or near the terminal ends 330*a*, 332*a*. One of the terminal ends 332*a* also comprises a second connector mechanism 346*a* to operatively connect to the front lift arm 206. In the preferred embodiment, the second connector mechanism 346*a* may be a bore through which the bottom end 212 of the front lift arm 206 can be inserted.

In the preferred embodiment, the connectors 342*a*, 344*a* are arcuate nubs. The reciprocal connectors 343*a*, 343*b* on the pedal levers 302*a*, 302*b* are slots configured to receive the arcuate nubs so as to prevent the pedal levers 302*a*, 302*b* from slipping off of the support arm 328*a*. This arrangement can be reversed with the nubs 342*a*, 344*a* protruding from the pedal levers 302*a*, 302*b* and the slots 343*a*, 343*b* located on the support arm 328*a*. Any other type of fastening mechanism can be used to secure the pedal levers 302*a*, 302*b* to the front support arm 328*a*.

In the preferred embodiment, to facilitate the rocking action of the front rocker arm 306*a*, the bottom edge 336*a* may be curved upwardly moving towards the terminal ends 330*a*, 332*a*. In some embodiments, the bottom edge 336*a* may be faceted with flat surfaces that start out horizontal directly beneath the front socket 326*a* and progressively increase in angle relative to the floor moving towards the terminal ends 330*a*, 332*a*. For example, in the preferred embodiment, when the bottom edge 336*a* directly beneath the front socket 326*a* (referred to as the middle facet) is placed horizontally with the floor. A portion of the bottom edge moving laterally to the left (referred to as the left facet), and a portion of the bottom edge moving laterally to the right (referred to as the right facet) may each bend slightly upwardly such that the middle facet and the right facet form and obtuse angle, and the middle facet and the left facet form an obtuse angle. This allows the left facet to be parallel to the floor when the left pedal is depressed and the right facet to be parallel to the floor when the right pedal is depressed.

In the preferred embodiment, the back rocker arm 306*b* is identical to the front rocker arm 306*a*. Therefore, the back rocker arm 306*b* comprises a back socket 326*b* configured to receive the rearward end 324 of the axle 310 so that the longitudinal axis L3 of the back socket 326*b* is coaxially aligned with the longitudinal axis L1 of the axle 310. The outer surface of the axle 310 is configured to mate with the inner surface of the back socket 326*b* such that rotation of the axle 310 about its longitudinal axis L1 causes rotation of the back socket 326*b* about its longitudinal axis L3. The back rocker arm 306*b* has a back support arm 328*b* projecting laterally from the back socket 326*b* and terminating at opposite terminal ends 330*b*, 332*b*. In some embodiments, the back support arm 328*b* may only project laterally on one side. The back support arm 328*b* has a top edge 334*b*, a bottom edge 336*b* opposite the top edge 334*b*, a front face 338*b* adjacent to the top and bottom edges, and a back face 340*b* opposite the front face and adjacent to the top and bottom edges. The back socket 326*b* may protrude forwardly and/or rearwardly away from the front and/or back faces 338*b*, 340*b* of the back support arm 328*b* so as to jut out from the front and/or back face 338*b*, 340*b*. The top edge 334*b* may comprise two connectors 342*b*, 344*b*, but these are not necessary as the back rocker arm 306*b* does not connect with the pedals. One of the terminal ends 332*b* also comprises a second connector mechanism 346*b* to operatively connect to the back lift arm 206. In the preferred embodiment, the second connector mechanism 346*b* may be a bore through which the bottom end 214 of the back lift arm 208 can be inserted.

In the preferred embodiment, to facilitate the rocking action of the back rocker arm 306*b*, the bottom edge 336*b* may be curved upwardly moving towards the terminal ends 330*b*, 332*b*. In some embodiments, the bottom edge 336*b* may be faceted with flat surfaces that start out horizontal directly beneath the back socket 326*b* and progressively increase in angle relative to the floor moving towards the terminal ends 330*b*, 332*b*, like the front rocker arm 306*a*. Therefore, the back rocker arm 306*b* may have the same middle facet, left facet, and right facet described above for the front rocker arm 306*a*.

Figure 17:
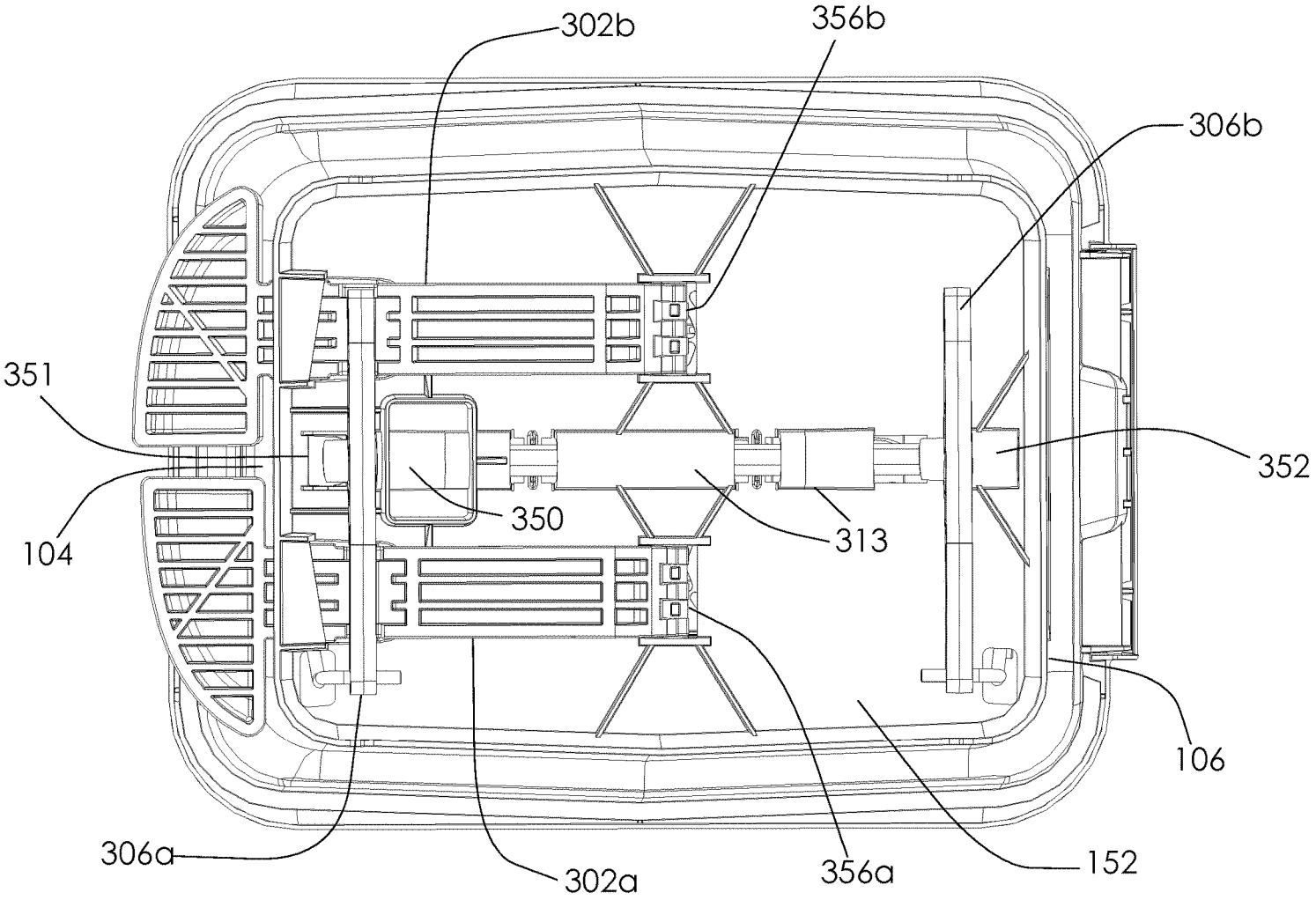
FIG. 17 shows a bottom view of the waste receptacle.

As shown in FIG. 17, the base 152 may provide the support structure for the pedal levers 302*a*, 302*b* and the front and back rocker arms 306*a*, 306*b* so as to suspend the front and back rocker arms 306*a*, 306*b* to allow for rotation and to allow the pedal levers 302*a*, 302*b* to move up and down. The base 152 may comprise a front bushing 350 adjacent to the front wall 104 and a back bushing 352 adjacent to the back wall 106. The bushings 350, 352 are configured to receive the sockets 326*a*, 326*b* of the front and back rocker arms 306*a*, 306*b*, respectively. The outer surfaces of each socket 326*a*, 326*b* are cylindrical in shape. The inner surfaces of each bushing 350, 352 are substantially similar to the outer surface of their respective sockets 326*a*, 326*b* so that the sockets 326*a*, 326*b* are able to rotate about their longitudinal axis while sitting in their respective bushings 350, 352.

At roughly the middle region between the front wall 104 and the back wall 106 are bilaterally arranged cylindrical bars 356*a*, 356*b* (such as a peg, dowel, pin, and the like) hanging below the bottom side of the base 152 with their longitudinal axes parallel to the front and back walls 104, 106. The proximal ends 318*a*, 318*b* of each lever arm 314*a*, 314*b* of the pedal levers 302*a*, 302*b* may each comprise a c-shaped opening 319*a*, 319*b*. The c-shaped openings 319*a*, 319*b* are configured to mate or snap-fit with their respective cylindrical bars 356*a*, 356*b* in a rotatable manner so as to define a hinge point at the proximal ends of the pedal levers 302*a*, 302*b*. With the pedal levers 302*a*, 302*b* mounted on the front rocker arm 306*a* at the distal ends 320*a*, 320*b*, and the proximal end 318*a*, 318*b* mounted to the base 152 via the c-shaped openings 319*a*, 319*b*, the pedal levers 302*a*, 302*b* are suspended off the floor and the distal ends 320*a*, 320*b* are capable of moving up and down while the proximal ends 318*a*, 318*b* remain fixed in location, but rotatable about their respective cylindrical bars 356*a*, 356*b*. A cover 313 may be provided to cover and protect the axle. The snap-fit connection makes it very easy to remove pedals in the event the user wants to use a hand actuator 301 to open and close the clamping mechanism.

Figure 18A:
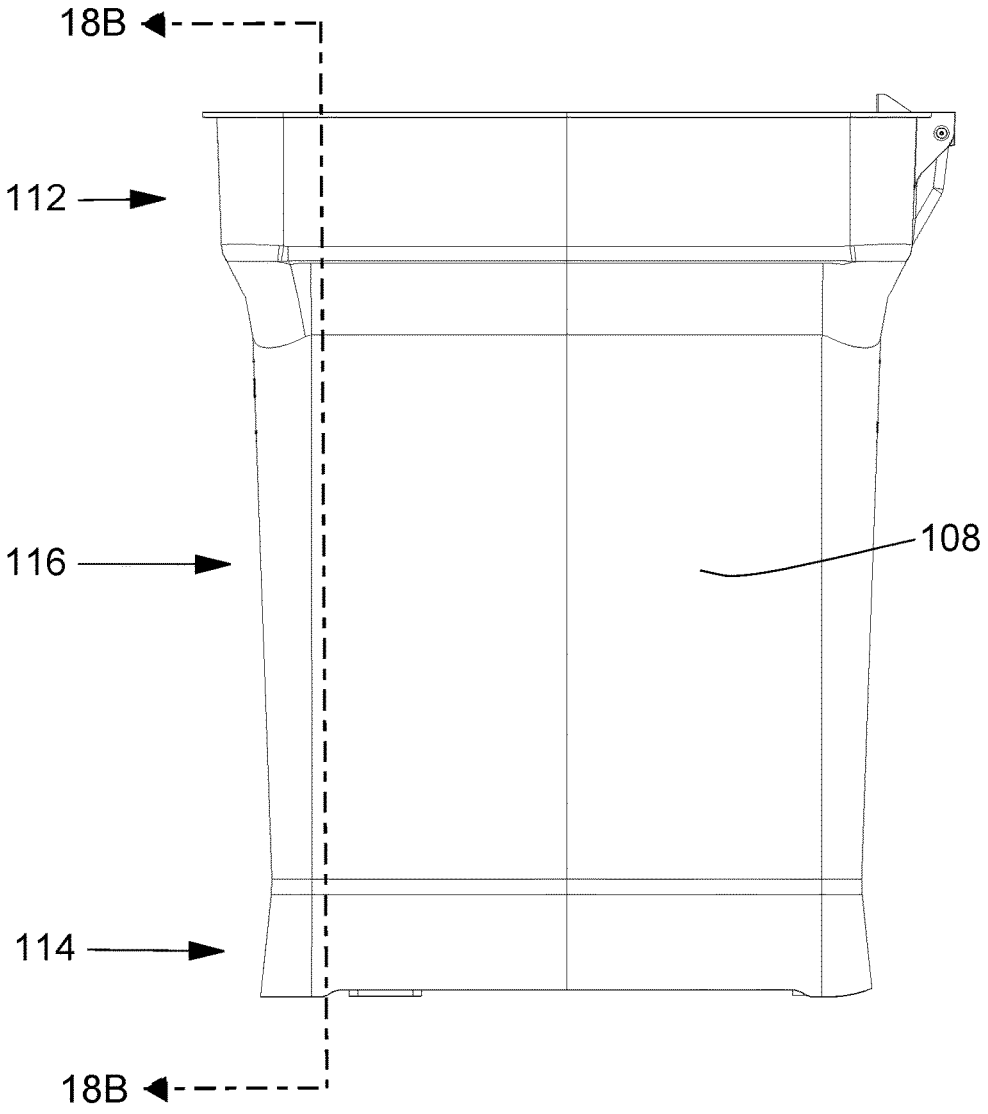
FIG. 18A shows a side view of the body.
Figure 18B:
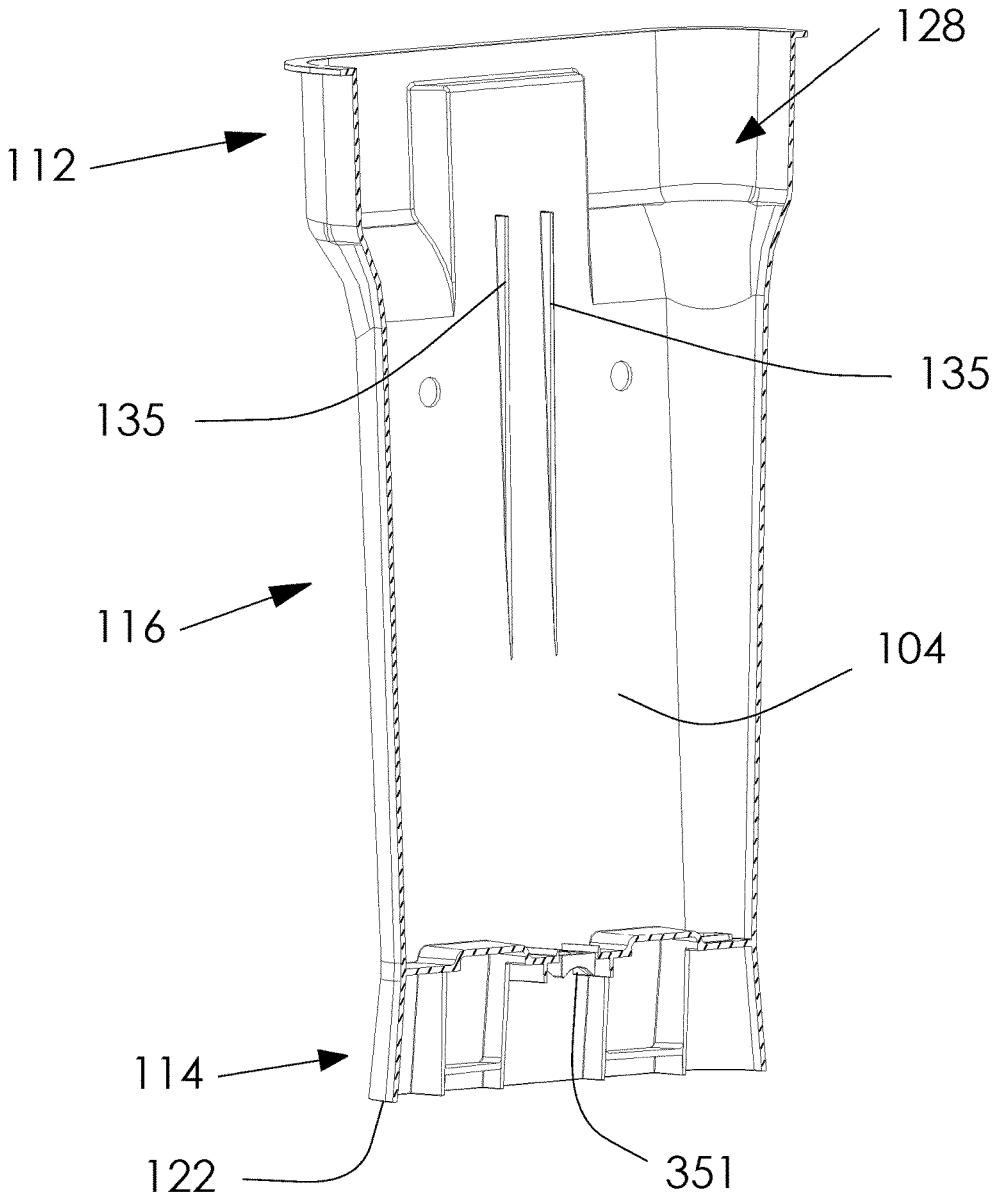
FIG. 18B shows a perspective cross-sectional view of the body taken along the line 18B-18B in FIG. 18A.

To prevent the front rocker arm 306*a* from any translational shift that would cause the front rocker arm 306*a* to slide off the front bushing 350, a stop 351 may be positioned or formed adjacent to the front rocker arm 306*a* opposite the front bushing 350 so as to sandwich the front rocker arm 306*a* in between the front bushing 350 and the stop 351. The stop may be in the shape of an open arch as shown in FIG. 18B, which shows a cross-section taken along line 18B-18B shown in FIG. 18A. The open arch minimizes obstruction when inserting the front rocker arm 306*a* into the front bushing 350.

Figure 19:
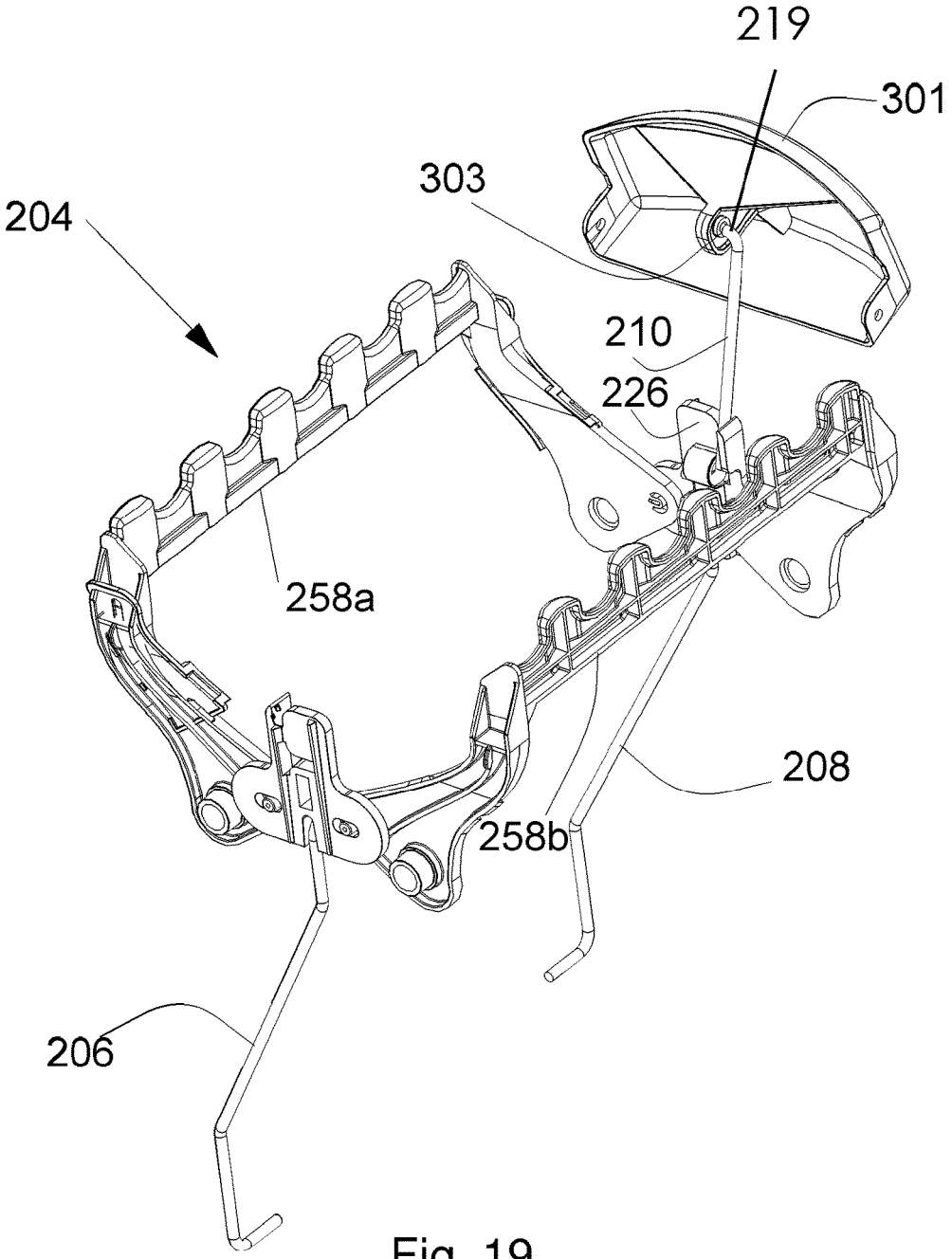
FIG. 19 shows a perspective view of a closing system with a hand actuator replacing the lid, and in an open position.

As shown in FIG. 19, the lid 202 may be replaced with a hand actuator 301. The hand actuator 301 connects with the extension arm 210 much like the lid 202. In the preferred embodiment, the hand actuator 301 has a closed slot or hole 303, through which the top end 219 of the extension arm 210 can be inserted. The hand actuator 301 comprises a relatively flat top with the hole 303 attached underneath the flat top. The extended lip 134 of the body 102 allows the hand actuator 301 to be attached to the body 102 much like the lid 202. The pins 136*a*, 136*b* can be used for mounting the hand actuator 301 onto the body 102 in a rotatable manner. When the hand actuator 301 is lifted upwardly and rotated about an axis defined by the pins 136*a*, 136*b* away from the body 102, the extension arm 210, being caught in the hole 303, applies an upward force on the back clamp actuator 226. When the hand actuator 301 is pushed downwardly and rotated about the axis defined by the pins 136*a*, 136*b* towards the body 102, the extension arm 210 may apply a downward force onto the back clamp actuator 226. Therefore, as the hand actuator 301 moves up and down, the clamp actuator 226 similarly moves up and down. When the hand actuator 301 is lifted upwardly, the clamping mechanism 204 is open and when the hand actuator 301 is pushed downwardly, the clamping mechanism 204 is closed. Thus, when the lid is replaced by the hand actuator 301, the pedal levers 302*a*, 302*b* may be removed. The waste receptacle may then be placed inside a cabinet with the handle facing the outside. To that effect, the body 102 may be dimensioned accordingly to fit inside various cabinet spaces. Alternatively, the body 102 can be dimensioned to be placed in the open similar to standard trash containers.

In an alternate embodiment, a separate mounting bracket may be used that is attachable to the base. In such an embodiment, the mounting bracket may be generally a rectangular block having a front end, a back end opposite the front end, a right and left sides, the right and left sides opposite each other and adjacent to the front end and back end, and top and bottom sides opposite each other and adjacent to the front and back ends, and right and left sides.

The front and back ends each comprise a bushing (front bushing 350 and back bushing 352, respectively) configured to receive the socket 326*a* of the front rocker arm 306*a* and the socket 326*b* of the back rocker arm 306*b*, respectively. The outer surfaces of the each socket 326*a*, 326*b* are cylindrical in shape. The inner surfaces of each bushing 350, 352 are substantially similar to the outer surface of their respective sockets 326*a*, 326*b*, so that the sockets 326*a*, 326*b* are able to rotate about their longitudinal axis while sitting in their respective bushings 350, 352. In some embodiments, the back end of the back bushing 352 is slanted inwardly towards top edge relative to the back wall 106. This slant corresponds with the expanded bottom portion 114 of the body 102 so that the back end of the back bushing 352 will be flush with the back wall 106 of the body 102 when the back bushing 352 is fitted into the slot in the bottom portion 114 of the back wall 106.

In some embodiments, adjacent to the back bushing 352 on the top side is a slot. The slot is configured to receive the support arm 328*b* of the back rocker arm 306*b* when the socket 326*b* of the back rocker arm 306*b* is placed into the back bushing 352. Since the socket 326*b* of the back rocker arm 306*b* juts away from the back face 340*b*, when the socket 326*b* of the back rocker arm 306*b* is placed into the back bushing 352, the support arm 328*b* of the back rocker arm 306*b* fits in the slot at the back end of the mounting bracket so that the support arm 328*b* can move up and down freely. Since the socket 326*a* of the front rocker arm 306*a* juts rearwardly, mounting the socket 326*a* of the front rocker arm 306*a* on the front bushing 326*a* still allows the support arm 328*a* of the front rocker arm 306*a* to clear the mounting bracket so as to allow free movement of the rocker arms 306*a*, 306*b* without interference from the mounting bracket.

In the alternate embodiment of the mounting bracket, the top side of the mounting bracket comprises a flanged support face extending along the length of the mounting bracket. The support face allows the mounting bracket to be secured to the base 152 of the body 102. The support face may comprise a series of bores, preferably, threaded bores, corresponding with the posts on the protruding downwardly from the base 152. The posts can be used to secure the mounting bracket to the base 152. Other fastening mechanisms can be used as well. The mounting bracket is dimensioned so as to be hidden in the bottom portion 114 of the body 102.

Roughly in the middle region of the support face are bilaterally arranged slotted supports. The proximal ends of each pedal lever 302*a*, 302*b* comprise a cylindrical protrusion (such as a peg, dowel, pin, and the like) that is inserted into the one of the slotted supports. The cylindrical protrusions are free to rotate within the slotted supports. With the pedal levers 302*a*, 302*b* mounted on the front rocker arm 306*a* at the distal ends 320*a*, 320*b*, and the slotted supports at the proximal ends 318*a*, 318*b*, the pedal levers 302*a*, 302*b* are suspended off the floor and the distal ends 320*a*, 320*b* is capable of moving up and down while the proximal ends 318*a*, 318*b* remains fixed in place.

The center of the mounting bracket comprises a channel through the top side and along the length of the mounting bracket. The channel provides space to receive the axle 310 when the front and back rocker arms 306*a*, 306*b* are mounted on the mounting bracket with the axle 310. The channel allows the axle 310 to rotate freely about is longitudinal axis.

In some embodiments, the actuator system 300 may comprise an automated sensor or control (not shown) that detects a signal nearby to automatically open and close the lid 202 and clamping mechanism 204. By way of example only, the sensor or control may be operatively connected to gears and an electric motor that would rotate the axle 310, move the lift arms 206, 208, move the clamp arms 252*a*, 252*b*, move the clamp actuators 224, 226, move the lid 202, or move some other component controlling the closing system 200. The sensor may be a motion detector, heat sensor, touch sensor, a push button, and the like. This embodiment may be battery-operated or plugged into the wall socket.

Carrier

Figure 20:
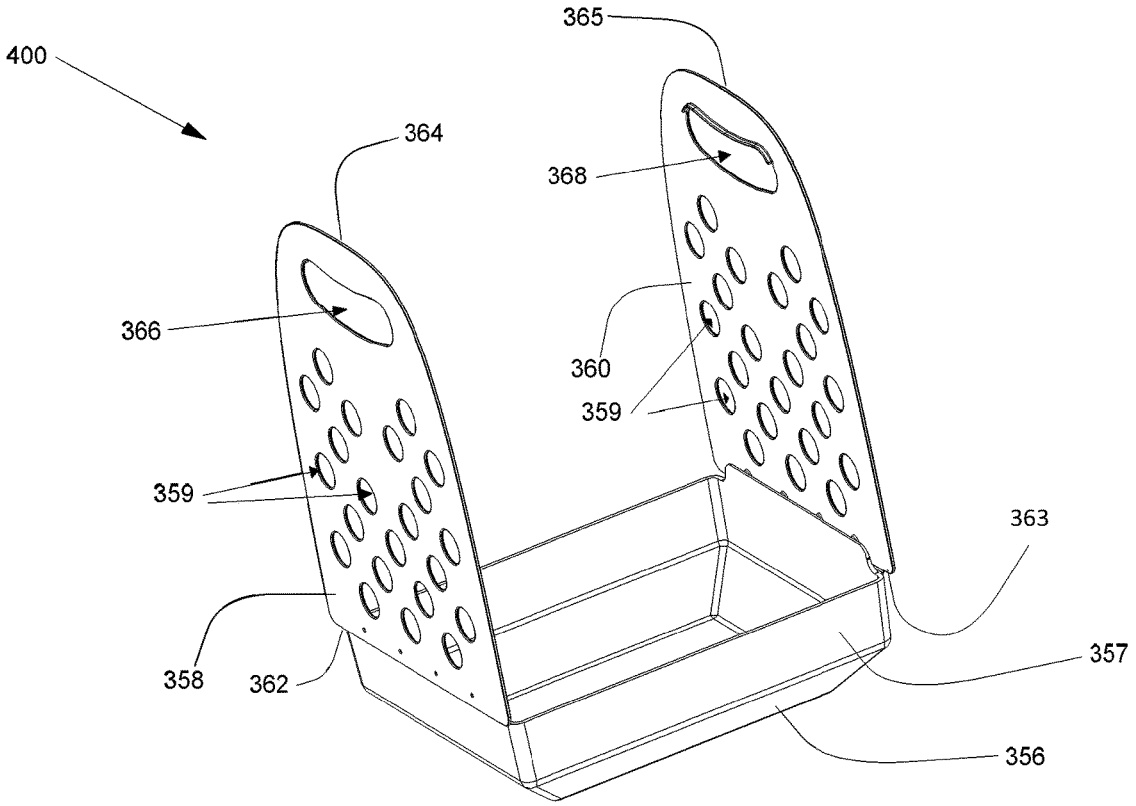
FIG. 20 shows a perspective view of the carrier.

In some embodiments, the receptacle 100 may further comprise a carrier 400. As shown in FIG. 20, the carrier 400 comprises a tray 356 and two opposing walls 358, 360 operatively connected to the tray 356. The two opposing walls 358, 360, each defines a bottom edge 362, 363 at which each is connected to the tray 356, and a top edge 364, 365, adjacent to each of which is an opening 366, 368, respectively. The openings 366, 368 are preferably bean-shaped, for two hands to hold the carrier 400. The opposing walls 358, 360 may be integrally formed with the tray 356 or attached to the tray 356. In the preferred embodiment, the opposing walls have holes 359. In some embodiments, the opposing walls 358, 360 are movably connected to the tray 356 with a hinge. In some embodiments, the opposing walls 358, 360 are connected to the tray 356 via a living hinge. The tray 356 may have raised walls 357 surrounding the tray 356 so as to provide a depth to the tray 356.

When used for composting, the carrier 400 may be used to hold compost tea, also known as leachate, which is essentially liquid run-off of decomposing compost that provides good nutrient for plants. If a user wishes to obtain the compost tea, he or she could purposefully leak the compost tea from the bottom of bag with compost in it into the tray 356 of the carrier 400. Using the carrier 400 provides a mess-free alternative to obtaining compost tea from a compost-filled bag in the receptacle. Even for any other types of trash, the carrier allows for an easy clean up if there is any leaking of waste from the bag or liner. In some embodiments, the base 152 may comprise guide posts 155 (see FIG. 3) for the tray 356 of the carrier 400.

In use, the carrier 400 sits inside the body 102 of the receptacle on top of the base 152. A bag is placed inside the body 102 on top of the tray 356. The perimeter edge defining the opening of the bag is folded over the clamp bars 258*a*, 258*b*. In some embodiments, adhesives, tacky silicone, and the like, on the clamp bars 258*a*, 258*b* may be used to hold the bag against the clamp bars 258*a*, 258*b*. In some embodiments, clips 280*a*, 280*b*, 282*a*, 282*b* are used to secure the bags. Any combination of these can also be used.

To open the receptacle 100, the user steps on the first pedal lever, for example, the right pedal lever 302*b*. Since the right pedal lever 302*b* is resting on the right side of the support arm 328*a* of the front rocker arm 306*a*, this causes the right terminal end 330*a* of the support arm 328*a* to move in a downward direction. Since the right side of the support arm 328*a* is attached to the socket 326*a* of the front rocker arm 306*a*, the socket 326*a* of the front rocker arm 306*a* rotates within the front bushing 350 in the clockwise direction. This causes the left terminal end 332*a* of the support arm 328*a* of the front rocker arm 306*a* to move upwardly.

Simultaneously, rotation of the socket 326*a* of the front rocker arm 306*a* causes the axle 310 to rotate in the same direction. Rotation of the axle 310 causes the back rocker arm 306*b* to rotate in the same direction causing left terminal end 332*b* of the support arm 328*b* of the back rocker arm 306*b* to lift upwards.

The upward movement of the left terminal ends 332*a*, 332*b* of the support arms 328*a*, 328*b* causes the front and back lift arms 206, 208 to move upwardly simultaneously. The lift arms 206, 208, being attached to their respective clamp actuators 224, 226, move the clamp actuators 224, 226 in an upward direction. Upward movement of the clamp actuators 224, 226 causes the central pegs 266*a*, 266*b* on the front arms 254*a*, 254*b* and central pegs 276*a*, 276*b* on the back arms 256*a*, 256*b* to move in an upward direction. Since the lateral pegs 264*a*, 264*b* on the front arms 254*a*, 254*b* are fixed against the front wall 104 from translational movement, and the lateral pegs 274*a*, 274*b* on the back arms 256*a*, 256*b* are fixed against the back wall 106 from translational movement, the clamp arms 252*a*, 252*b* rotate about the lateral pegs 264*a*, 264*b*, 274*a*, 274*b*. The right clamp bar 258*b* rotates in the clockwise and the left clamp bar 258*a* rotates in a counterclockwise direction about the lateral pegs 264*a*, 264*b*, 274*a*, 274*b*. This causes the clamp bars 258*a*, 258*b* to move away from each other, thereby opening the bag placed inside.

Simultaneously, the extension arm 210 on the back lift arm 208 also moves in an upward direction. Since the extension arm 210 is connected to or abuts against the lid 202, the lid 202 opens at the same time the clamp arms 252*a*, 252*b* move apart. The user can now discard any waste into the bag. Pressing on the opposite pedal (left pedal 302*a*), moves each component in reverse, thereby simultaneously closing the clamp arms 252*a*, 252*b* and the lid 202. When the user is ready to discard the waste, the user can open the receptacle 100 as described above. The user can then grab the handles of the carrier and carry the waste to the desired location for proper disposal.

The waste receptacle 100, and any components thereof, can generally be made using materials such as plastic, metal, wood, or any combination thereof. For example, injection molding techniques may be used to fabricate various components of the invention.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A receptacle, comprising:

a. a body, the body comprising a front wall, a back wall opposite the front wall, a right wall adjacent to the front and back walls, a left wall opposite the right wall and adjacent to the front and back walls, and a base adjacent to the front, back, right, and left walls, wherein the body defines a cavity;

b. an actuating system operatively connected to the body; and c. a closing system operatively connected to the actuating system and the body, the closing system comprising:

i. a clamping mechanism comprising a pair of clamp arms operable to move laterally away from each other, and medially toward each other, wherein when the clamp arms are moved laterally away from each other the closing system is in an open configuration, and when the clamp arms abut each other a tight seal is created between the clamp arms and the closing system is in a closed configuration, wherein the clamping mechanism comprises a front clamp actuator and a back clamp actuator, the front and back clamp actuators operatively connected to the clamp arms, such that movement of the clamp actuators in an upward direction causes the clamp arms to move into the open configuration, and movement of the clamp actuators in a downward direction causes the clamp arms to move into the closed configuration, wherein each clamp arm comprises a front arm adjacent to the front wall, a back arm adjacent to the back wall, and a clamp bar therebetween operatively connected to the front and back arms, the front and back arms each having a base with an upwardly projecting connector arm, the connector arms connected to their respective clamp bars, thereby positioning the bases below their respective clamp bars, the bases each comprising a central peg and a lateral peg at opposite ends, the central pegs positioned inwardly towards a centerline of their respective front and back walls, the lateral pegs positioned laterally closer to the left or right walls, respectively, wherein the front arms are attached to the front wall via their respective lateral pegs in a rotatable manner, and wherein the back arms are attached to the back wall via their respective lateral pegs in a rotatable manner, wherein each clamp bar comprises a plurality of fingers arranged in an alternating fashion relative to each other such that when the clamp bars are in the closed configuration the plurality of fingers from a first clamp bar interlocks with the plurality of fingers of a second clamp bar, ii. a front lift arm having a bottom end connected to the actuating system and a top end connected to the front clamp actuator, iii. a back lift arm having a bottom end connected the actuating system and a top end connected to the back clamp actuator; and iv. an extension arm having a bottom end connected to the back clamp actuator and a top end opposite the bottom end of the extension arm, wherein the actuating system causes movement of the front lift arm, back lift arm, and extension arm, which causes movement of the clamp arms between the open and the closed configuration.

2. The receptacle of claim 1, further comprising a handle attached to the top end of the extension arm to operate in conjunction with the clamping mechanism.

3. The receptacle of claim 1, further comprising a lid attached to the top end of the extension arm to open and close with the clamping mechanism.

4. The receptacle of claim 1, further comprising a carrier removably positioned inside the body.

5. A receptacle, comprising:

a. a body;

b. a closing system, the closing system comprising a clamping mechanism comprising:

i. a pair of clamp arms operable to move laterally away from each other, and medially toward each other, wherein when the clamp arms are moved laterally away from each other the closing system is in an open configuration, and when the clamp arms abut each other to create a tight seal between the clamp arms, the closing system is in a closed configuration, ii. a front clamp actuator adjacent to a front wall of the body, the front clamp actuator operatively connected to the pair of clamp arms; and iii. a back clamp actuator adjacent to a back wall of the body, the back clamp actuator operatively connected to the pair of clamp arms opposite the front clamp actuator, such that movement of the front and back clamp actuators in an upward direction causes the pair of clamp arms to move into the open configuration, and movement of the clamp actuators in a downward direction causes the clamp arms to move into the closed configuration; and c. an actuating system operatively connected to the closing system to open and close the pair of clamp arms.

6. The receptacle of claim 5, wherein each clamp arm comprises a front arm, a back arm opposite the front arm, and a clamp bar therebetween operatively connected to the front and back arms, the front and back arms each having a base with an upwardly projecting connector arm, the connector arms connected to their respective clamp bars, thereby positioning the bases below their respective clamp bars, the bases each comprising a central peg and a lateral peg at opposite ends, the lateral pegs positioned laterally relative to their respective central pegs, wherein the front arms are attached to the body via their lateral pegs in a rotatable manner, wherein the back arms are attached to the body via their lateral pegs in a rotatable manner, and wherein the front clamp actuator and the back clamp actuator are connected to the clamp arms via the central pegs of the front and back arms, respectively.

7. The receptacle of claim 6, wherein each clamp bar comprises a plurality of fingers arranged in an alternating fashion relative to each other such that when the clamp bars are in the closed configuration the plurality of fingers from a first clamp bar interlocks with the plurality of fingers of a second clamp bar.

8. The receptacle of claim 5, further comprising a spring attached to the pair of clamp arms to create a laterally-directed biasing force.

9. The receptacle of claim 5, further comprising bag clips attached to the pair of clamp arms to secure a bag to the pair of clamp arms.

10. The receptacle of claim 5, wherein the actuating system comprises a hand actuator operatively connected to the pair of clamp arms.

11. The receptacle of claim 5, further comprising a lid operatively connected to the pair of clamp arms to open and close with the clamping mechanism.

12. The receptacle of claim 5, further comprising a carrier removably positioned inside the body.

13. A receptacle, comprising:

a. a body defining a cavity;

b. a closing system connected to the body, the closing system comprising a clamping mechanism, the clamping mechanism comprising a pair of clamp arms operable to move laterally away from each other in an open configuration, and medially toward each other in a closed configuration, wherein each clamp arm comprises a front arm, a back arm opposite the front arm, and a clamp bar therebetween operatively connected to the front and back arms, wherein the front arms are attached to a front wall of the body in a rotatable manner, and wherein the back arms are attached to a back wall of the body in a rotatable manner; and c. an actuating system operatively connected to the closing system to open and close the clamping mechanism.

14. The receptacle of claim 13, wherein the front and back arms each having a base with an upwardly projecting connector arm, the connector arms connected to their respective clamp bars, thereby positioning the bases below their respective clamp bars, the bases each comprising a central peg and a lateral peg adjacent to the central peg, the central pegs positioned inwardly towards a centerline of their respective front and back walls, the lateral pegs positioned laterally relative to their respective central pegs.

15. The receptacle of claim 14, further comprising a clamp actuator the clamp actuator operatively connected to the clamp arms, such that movement of the clamp actuator in a first direction causes the clamp arms to move into the open configuration, and movement of the clamp actuator in a second direction causes the clamp arms to move into the closed configuration.

16. The receptacle of claim 14, wherein each clamp bar comprises a plurality of fingers arranged in an alternating fashion relative to each other such that when the clamp bars are in the closed configuration the plurality of fingers from a first clamp bar interlocks with the plurality of fingers of a second clamp bar.

17. The receptacle of claim 13, wherein the actuating system comprises a hand actuator operatively connected to the pair of clamp arms.

18. The receptacle of claim 13, further comprising a spring attached to the pair of clamp arms to create a laterally-directed biasing force.

19. The receptacle of claim 13, further comprising bag clips attached to the pair of clamp arms to secure a bag to the pair of clamp arms.

20. The receptacle of claim 13, further comprising a lid operatively connected to the pair of clamp arms to open and close with the clamping mechanism.

21. The receptacle of claim 13, further comprising a carrier removably positioned inside the body.

* * * * *